US009322245B2

(12) United States Patent
Nicholson

(10) Patent No.: US 9,322,245 B2
(45) Date of Patent: Apr. 26, 2016

(54) METAL ENCASED CABLE POWER DELIVERY SYSTEM FOR DOWNHOLE PUMPING OR HEATING SYSTEMS

(71) Applicant: SCHLUMBERGER TECHNOLOGY CORPORATION, Sugar Land, TX (US)

(72) Inventor: Joseph Allan Nicholson, Broughton in Furness (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 215 days.

(21) Appl. No.: 13/892,275

(22) Filed: May 11, 2013

(65) Prior Publication Data

US 2013/0309888 A1 Nov. 21, 2013

Related U.S. Application Data

(60) Provisional application No. 61/648,872, filed on May 18, 2012.

(51) Int. Cl.

| | |
|---|---|
| ***H01R 4/60*** | (2006.01) |
| ***E21B 36/00*** | (2006.01) |
| ***E21B 17/02*** | (2006.01) |

(52) U.S. Cl.

CPC ..... *E21B 36/00* (2013.01); *E21B 17/025* (2013.01)

(58) Field of Classification Search

CPC ..... H01R 13/005; H01R 4/363; H01R 4/36; H01R 13/5205; H01R 4/70; H01R 9/0521; F16L 25/01; E21B 17/028; H02G 15/04; H02G 15/013

USPC ..... 439/191, 192, 194, 589, 797, 798; 174/76, 77 R, 84 R, 89

See application file for complete search history.

(56) References Cited

U.S. PATENT DOCUMENTS

| | | | | | |
|---|---|---|---|---|---|
| 5,052,841 | A * | 10/1991 | Jozat et al. | ..... | 401/258 |
| 5,334,801 | A * | 8/1994 | Mohn | ..... | 174/47 |
| 5,762,135 | A * | 6/1998 | Moore | ..... | 166/65.1 |
| 5,927,402 | A * | 7/1999 | Benson et al. | ..... | 166/65.1 |
| 5,952,612 | A * | 9/1999 | Winfield et al. | ..... | 174/74 R |
| 7,059,881 | B2 * | 6/2006 | Song et al. | ..... | 439/191 |
| 7,232,347 | B1 * | 6/2007 | Moore | ..... | 439/797 |
| 7,674,124 | B2 | 3/2010 | Nicholson | | |
| 8,747,134 | B2 * | 6/2014 | Schlogl | ..... | 439/194 |
| 2009/0047815 | A1 | 2/2009 | Nicholson | | |

FOREIGN PATENT DOCUMENTS

DE 3718517 12/1988

OTHER PUBLICATIONS

Combined Search and Examination Report for the equivalent GB patent application No. 1308911.5 issued on Nov. 15, 2013.

* cited by examiner

*Primary Examiner* — Thanh Tam Le
(74) *Attorney, Agent, or Firm* — Michael Stonebrook

(57) ABSTRACT

An assembly can include a housing that includes an opening, a bore extending from the opening along an axis and a sealable port; and a cable feed-through body that includes a first axial end, a second axial end, a bore extending between the axial ends, a tapered bore surface and a sealable port, the cable feed-through body being partially disposed within the bore of the housing to locate the second axial end at an axial distance from the opening of the housing that exceeds an axial distance of the sealable port of the housing to at least in part form a gland seal between the cable feed-through body and the bore of the housing. Various other apparatuses, systems, methods, etc., are also disclosed.

16 Claims, 14 Drawing Sheets

METAL ENCASED CABLE POWER DELIVERY SYSTEM FOR DOWNHOLE PUMPING OR HEATING SYSTEMS

RELATED APPLICATIONS

This application claims the benefit of and priority to U.S. Provisional Application Ser. No. 61/648,872, filed 18 May 2012, which is incorporated by reference herein.

BACKGROUND

Electrically coupled downhole equipment rely on a cable or cables for delivery of electricity, for example, to power the equipment, to control the equipment, to receive signals from the equipment, etc. Downhole environments may be harsh, for example, physically (e.g., consider temperature and pressure) and chemically (e.g., consider chemical corrosion). Examples of downhole equipment include downhole heaters and downhole pumps. As an example, a downhole heater may be installed at a bottom of a well to increase the temperature of fluid coming from the reservoir (e.g., to reduce fluid viscosity). As another example, a downhole heater may be installed as a heater treater, for example, to assist with elimination of paraffin deposits, hydrate plugs, etc. As an example, a downhole pump may be an electric submersible pump (ESP) to achieve artificial lift of fluid.

To receive power to heat or to pump, a downhole heater or pump is connected to a cable or cables. In some instances, the length of such a cable or cables may be of the order of several kilometers. A cable may also include one or more lead extensions spliced onto the cable. For example, where the cable includes three conductor cores for powering a pump motor, a motor lead extension (MLE) may be spliced onto each of the conductor cores.

As an example, one or more packers may be installed downhole, for example, uphole from a location of downhole equipment such that a cable or cables passes or pass through the packer. As an example, a completion may include a packer that isolates an annulus from a production conduit (e.g., to enable controlled production, injection, treatment, etc.) where a heater or a pump is installed downhole from the packer. Such a packer may include features to secure the packer against a casing, liner wall, etc. (e.g., consider a slip arrangement), features to create a fluid seal to isolate the annulus (e.g., consider an expandable elastomeric element or other arrangement) and features to create a fluid seal for each cable that may pass through the packer.

Various technologies, techniques, etc., described herein pertain to cables and coupling mechanisms, for example, to power one or more pieces of equipment that may be positioned in a borehole, a well, or other environment.

SUMMARY

An assembly can include a housing that includes an opening, a bore extending from the opening along an axis and a sealable port; and a cable feed-through body that includes a first axial end, a second axial end, a bore extending between the axial ends, a tapered bore surface and a sealable port, the cable feed-through body being partially disposed within the bore of the housing to locate the second axial end at an axial distance from the opening of the housing that exceeds an axial distance of the sealable port of the housing to at least in part form a gland seal between the cable feed-through body and the bore of the housing.

An assembly can include an uphole body portion and a downhole body portion, the body portions being connectable to form a cavity therein, where the uphole body portion includes an uphole bore and an uphole tapered bore surface and where the downhole body portion includes a downhole bore and a downhole tapered bore surface; an insulator block disposed within the cavity where the insulator block includes a through bore axially aligned with the uphole bore of the uphole body portion and the downhole bore of the downhole body portion; and a boot seal component disposed in the through bore of the insulator block where the boot seal component includes an uphole sleeve for latching an uphole conductor, a downhole sleeve for latching a downhole conductor and a coupling conductor for electrically coupling the uphole conductor and the downhole conductor.

A method can include providing a cable with a compression nut and a ferrule; providing a housing with a cable feed-through body with a sealable port; inserting the cable into the cable feed-through body; and torqueing the compression nut to the cable feed-through body to apply force to the ferrule to form a seal. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

Figure 1:
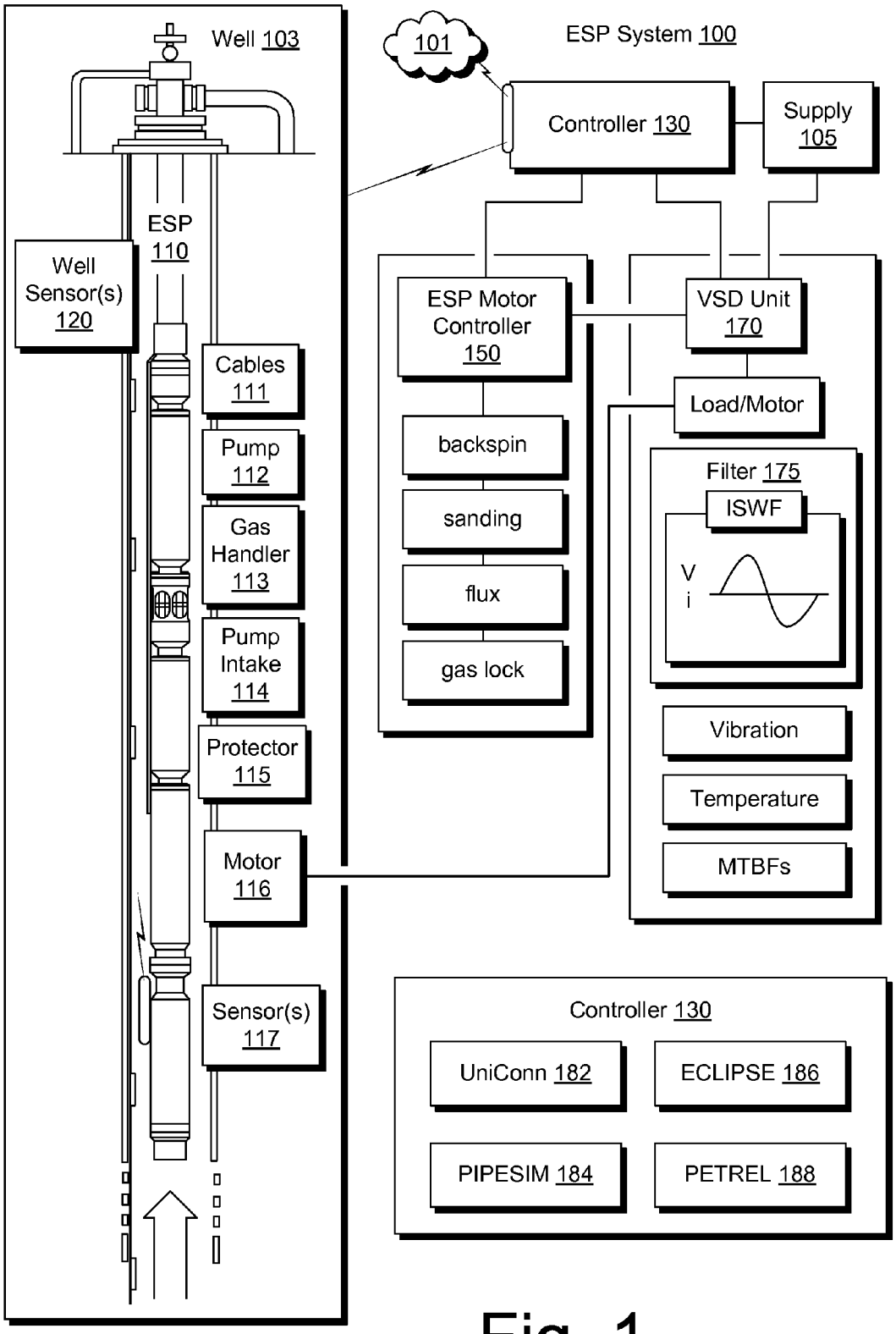
FIG. 1 illustrates an example of an electric submersible pump (ESP) system that includes a variable speed drive (VSD)

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Electric submersible pumps (ESPs) may be deployed for any of a variety of pumping purposes. For example, where a substance does not readily flow responsive to existing natural forces, an ESP may be implemented to artificially lift the substance. Commercially available ESPs (such as the REDA™ ESPs marketed by Schlumberger Limited, Houston, Tex.) may find use in applications that include, for example, pump rates in excess of 4,000 barrels per day and lift of 12,000 feet or more.

A downhole heater may be deployed for any of a variety of purposes. For example, where a substance does not readily flow responsive to existing natural forces, a downhole heater may be implemented to deliver heat energy, which may act to reduce viscosity of fluid, change state of a substance, etc. A downhole heater may be a heater treater, for example, to assist with elimination of paraffin deposits, hydrate plugs, etc.

An ESP or other downhole equipment may include one or more electrically powered components. As an example, a motor may be driven via a 3-phase power supply and a power cable or cables that provide a 3-phase AC power signal. Voltage and current levels of a 3-phase AC power signal provided by a power supply to an ESP motor may be, for example, of the order of kilovolts and tens of amperes.

As an example, an ESP may include one or more sensors (e.g., gauges) that measure any of a variety of phenomena (e.g., temperature, pressure, vibration, etc.). A commercially available sensor is the Phoenix MultiSensor™ marketed by Schlumberger Limited (Houston, Tex.), which monitors intake and discharge pressures; intake, motor and discharge temperatures; and vibration and current-leakage. An ESP monitoring system may include a supervisory control and data acquisition system (SCADA). Commercially available surveillance systems include the espWatcher™ and the LiftWatcher™ surveillance systems marketed by Schlumberger Limited (Houston, Tex.), which provide for communication of data, for example, between a production team and well/field data equipment (e.g., with or without SCADA installations). Such a system may issue instructions to, for example, start, stop or control ESP speed via an ESP controller.

As to power to power a sensor (e.g., an active sensor), circuitry associated with a sensor (e.g., an active or a passive sensor), or a sensor and circuitry associated with a sensor, a DC power signal may be provided via an ESP cable and available at a wye point of an ESP motor, for example, powered by a 3-phase AC power signal.

As an example, a power cable may provide for delivery of power to an ESP, other downhole equipment or an ESP and other downhole equipment. Such a power cable may also provide for transmission of data to downhole equipment, from downhole equipment or to and from downhole equipment.

As to issues associated with ESP operations, a power supply may experience unbalanced phases, voltage spikes, presence of harmonics, lightning strikes, etc., which may, for example, increase temperature of an ESP motor, a power cable, etc.; a motor controller may experience issues when subjected to extreme conditions (e.g., high/low temperatures, high level of moisture, etc.); an ESP motor may experience a short circuit due to debris in its lubricating oil, water breakthrough to its lubricating oil, noise from a transformer which results in wear (e.g., insulation, etc.), which may lead to lubricating oil contamination; and a power cable may experience one or more issues (e.g. short circuit or other) due to electric discharge in insulation surrounding one or more conductors (e.g., more probable at higher voltages), poor manufacturing quality (e.g., of insulation, armor, etc.), water breakthrough, noise from a transformer, direct physical damage (e.g., crushing, cutting, etc.) during running or pulling operations), chemical damage (e.g., corrosion), deterioration due to high temperature, current above a design limit resulting in temperature increase, electrical stresses, etc.

Some of the foregoing examples of issues may be germane to operation of other types of downhole equipment. For example, cable related issues may apply to a downhole heater installation. In various examples, cables and coupling mechanisms, for example, to power one or more pieces of equipment that may be positioned in a borehole, a well, or other environment, are illustrated or described with respect to an ESP installation; noting that such cable and coupling mechanisms may be employed for other types of equipment.

FIG. 1 shows an example of an ESP system 100 as including a network 101, a well 103 disposed in a geologic environment, a power supply 105, an ESP 110, a controller 130, a motor controller 150 and a VSD unit 170. The power supply 105 may receive power from a power grid, an onsite generator (e.g., natural gas driven turbine), or other source.

In the example of FIG. 1, the well 103 includes a wellhead that can include a choke (e.g., a choke valve). For example, the well 103 can include a choke valve to control various operations such as to reduce pressure of a fluid from high pressure in a closed wellbore to atmospheric pressure. Adjustable choke valves can include valves constructed to resist wear due to high-velocity, solids-laden fluid flowing by restricting or sealing elements. A wellhead may include one or more sensors such as a temperature sensor, a pressure sensor, a solids sensor, etc.

The ESP 110 includes cables 111, a pump 112, gas handling features 113, a pump intake 114, a protector 115, a motor 116, and one or more sensors 117 (e.g., temperature, pressure, current leakage, vibration, etc.). The well 103 may include one or more well sensors 120, for example, such as the commercially available OpticLine™ sensors or WellWatcher BriteBlue™ sensors marketed by Schlumberger Limited (Houston, Tex.). Such sensors are fiber-optic based and can provide for real time sensing of temperature, for example, in steam-assisted gravity drainage (SAGD) or other operations (e.g., enhanced oil recovery, etc.). With respect to SAGD, as an example, a well may include a relatively horizontal portion. Such a portion may collect heated heavy oil responsive to steam injection and an ESP may be positioned horizontally to enhance flow of the heavy oil.

In the example of FIG. 1, the controller 130 can include one or more interfaces, for example, for receipt, transmission or receipt and transmission of information with the motor controller 150, a VSD unit 170, the power supply 105 (e.g., a gas fueled turbine generator, a power company, etc.), the network 101, equipment in the well 103, equipment in another well, etc.

As shown in FIG. 1, the controller 130 can include or provide access to one or more modules or frameworks. Further, the controller 130 may include features of an ESP motor controller and optionally supplant the ESP motor controller 150. For example, the controller 130 may include the UniConn™ motor controller 182 marketed by Schlumberger Limited (Houston, Tex.). In the example of FIG. 1, the controller 130 may access one or more of the PIPESIM™ framework 184 marketed by Schlumberger Limited (Houston, Tex.), the ECLIPSE™ framework 186 marketed by Schlumberger Limited (Houston, Tex.) and the PETREL™ framework 188 marketed by Schlumberger Limited (Houston, Tex.).

In the example of FIG. 1, the motor controller 150 may be a commercially available motor controller such as the UniConn™ motor controller. The UniConn™ motor controller can connect to a SCADA system, the espWatcher™ surveillance system marketed by Schlumberger Limited (Houston, Tex.), etc. The UniConn™ motor controller can interface with fixed speed drive (FSD) controllers or a VSD unit, for example, such as the VSD unit 170.

For FSD controllers, the UniConn™ motor controller can monitor ESP system three-phase currents, three-phase surface voltage, supply voltage and frequency, ESP spinning frequency and leg ground, power factor and motor load.

For VSD units, the UniConn™ motor controller can monitor VSD output current, ESP running current, VSD output voltage, supply voltage, VSD input and VSD output power, VSD output frequency, drive loading, motor load, three-phase ESP running current, three-phase VSD input or output voltage, ESP spinning frequency, and leg-ground.

In the example of FIG. 1, the ESP motor controller 150 includes various modules to handle, for example, backspin of an ESP, sanding of an ESP, flux of an ESP and gas lock of an ESP. As mentioned, the motor controller 150 may include any of a variety of features, additionally, alternatively, etc.

In the example of FIG. 1, the VSD unit 170 may be a medium voltage drive (MVD) unit or a low voltage drive (LVD). For a MVD, a VSD unit can include an integrated transformer and control circuitry. As an example, the VSD unit 170 may receive power with a voltage of about 4.16 kV and control a motor as a load with a voltage from about 0 V to about 4.16 kV. As an example, a MVD VSD unit may operate using voltage levels up to about 6 kV. In contrast, a LVD may operate with three phase, multilevel PWM in a range from about 0 V to an input voltage level, which may be, for example, about 380 V or, for example, up to about 480 V. As an example, a range for a MVD may be from about 1 kV to about 6 kV.

The VSD unit 170 may include commercially available control circuitry such as the SpeedStar™ MVD control circuitry marketed by Schlumberger Limited (Houston, Tex.). The SpeedStar™ MVD control circuitry is suitable for indoor or outdoor use and may include a visible fused disconnect switch, precharge circuitry, and sine wave output filter 175 (e.g., integral sine wave filter, ISWF) tailored for control and protection of ESP circuitry (e.g., an ESP motor).

In the example of FIG. 1, the VSD unit 170 is shown along with a plot of a sine wave (e.g., achieved via the sine wave output filter 175) and modules that may provide for responsiveness to vibration, responsiveness to temperature and management to reduce mean time between failures (MTBFs). As an example, the VSD unit 170 may be rated with an ESP to provide for about 40,000 hours (5 years) of operation at a temperature of about 50 C. with about a 100% load. The VSD unit 170 may include surge and lightening protection (e.g., one protection circuit per phase). As to leg-ground monitoring or water intrusion monitoring, such types of monitoring can indicate whether corrosion is or has occurred. Further monitoring of power quality from a supply, to a motor, at a motor, may occur by one or more circuits or features of a controller.

While the example of FIG. 1 shows an ESP with centrifugal pump stages, another type of ESP may be controlled. For example, an ESP may include a hydraulic diaphragm electric submersible pump (HDESP), which is a positive-displacement, double-acting diaphragm pump with a downhole motor. HDESPs find use in low-liquid-rate coalbed methane and other oil and gas shallow wells that may implement artificial lift to remove water from the wellbore. A HDESP can be set above or below the perforations and run in wells that are, for example, less than about 2,500 ft deep and that produce less than about 200 barrels per day. HDESPs may handle a wide variety of fluids and, for example, up to about 2% sand, coal, fines and $H_2S/CO_2$. As to materials of construction, materials such as, for example, those used in commercially available REDA™ or other submersible pumps for use in the oil and gas industry may be used.

Failure of a cable, a cable coupling assembly, or electrically coupled downhole equipment may cause an operator to incur various costs such as costs for removal and replacement as well as downtime. As a cable may extend a considerable length, it may be exposed to a variety of different environments, some of which may change over time. Forces that impact a cable, whether mechanical forces, electrical forces, temperature-related forces, fluid pressure-related forces, or chemical-related forces, may also impact a cable coupling assembly. Data collected from a particular region indicate that as many as half of the failures for deployed ESPs were due to the power delivery system and not due to individual ESP motors or pumps. In various examples, techniques and technologies for cables and cable coupling assemblies may help to eliminate failure points, reduce on-site human errors, speed-up field installation, etc. Such techniques and technologies may increase the MTBF of downhole equipment. As an example, a target run life of about a decade or more may be achieved for a power delivery system.

As an example, a power delivery system may include: metal encased cable (e.g., to resist downhole fluids and gasses); a pressure-rated motor feed-through system (e.g., to isolate the motor against the effects of seal failures at the cable interface); a metal-to-metal seal system which may be optionally testable at various interfaces; a packer penetration system which may be directly attached to a packer (e.g., to minimize on-site installation); and a cable termination system that includes tooling for swaging and optionally seal testing.

Figure 2:
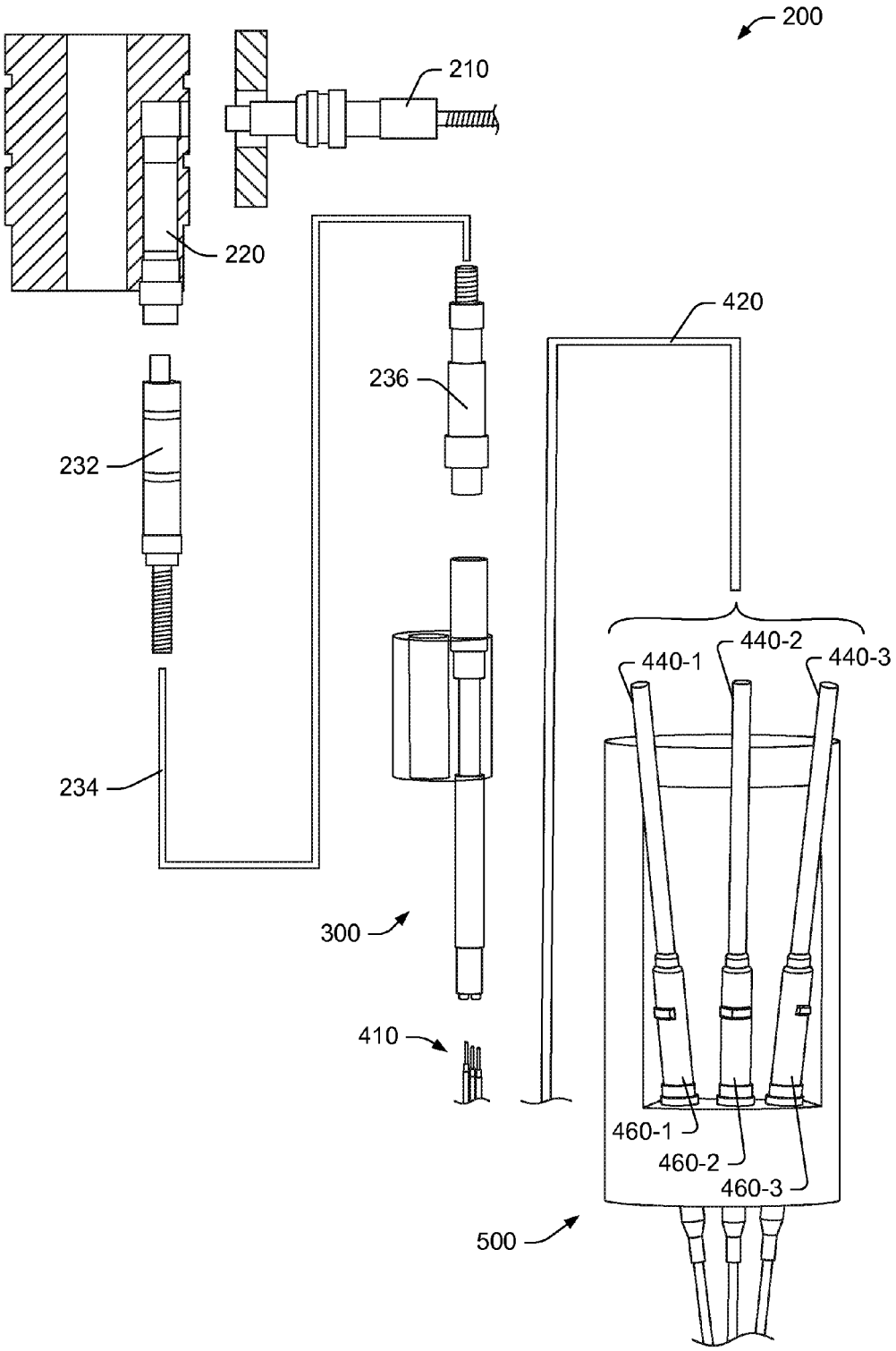
FIG. 2 illustrates an example of a cable system.

FIG. 2 shows an example of a cable system 200 that includes: an upper surface dry-mate connector 210; a pressure feed-through mandrel 220; an upper field installable dry-mate connector 232; a cable 234 (e.g., with three conductive cables therein); a lower field installable dry-mate connector 236; a packer feed-through assembly 300; upper cable leads 410-1, 410-2 and 410-3; cables 420; cable leads 440-1, 440-2 and 440-3; and motor feed-through cable casings 460-1, 460-2 and 460-3 that couple to a penetrator block 500 (e.g., a metal penetrator block, a metal housing, etc.).

Figure 3:
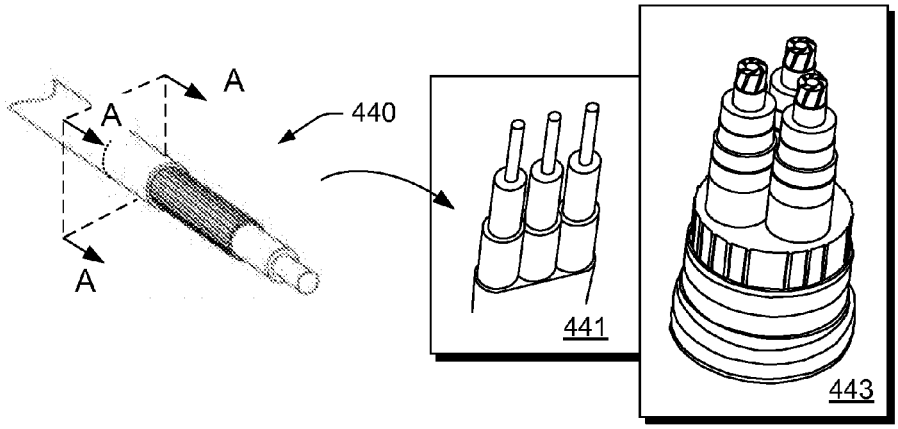
FIG. 3 illustrates an example of a cable.
Figure 3:
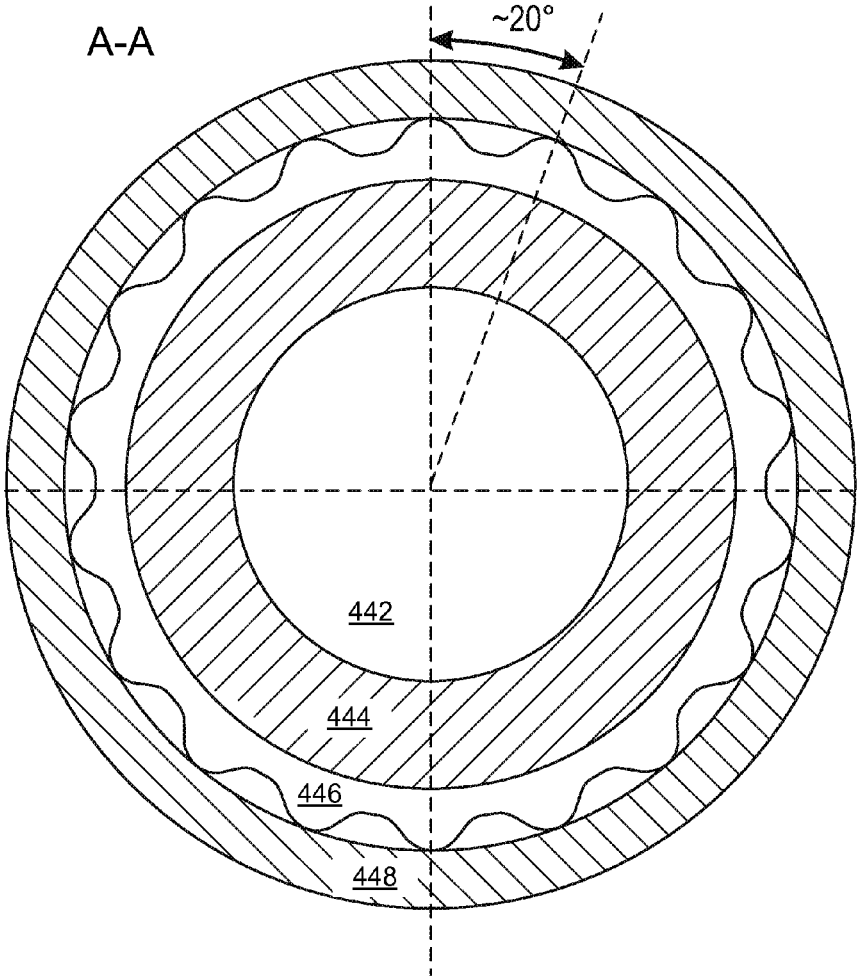
Figure 4:
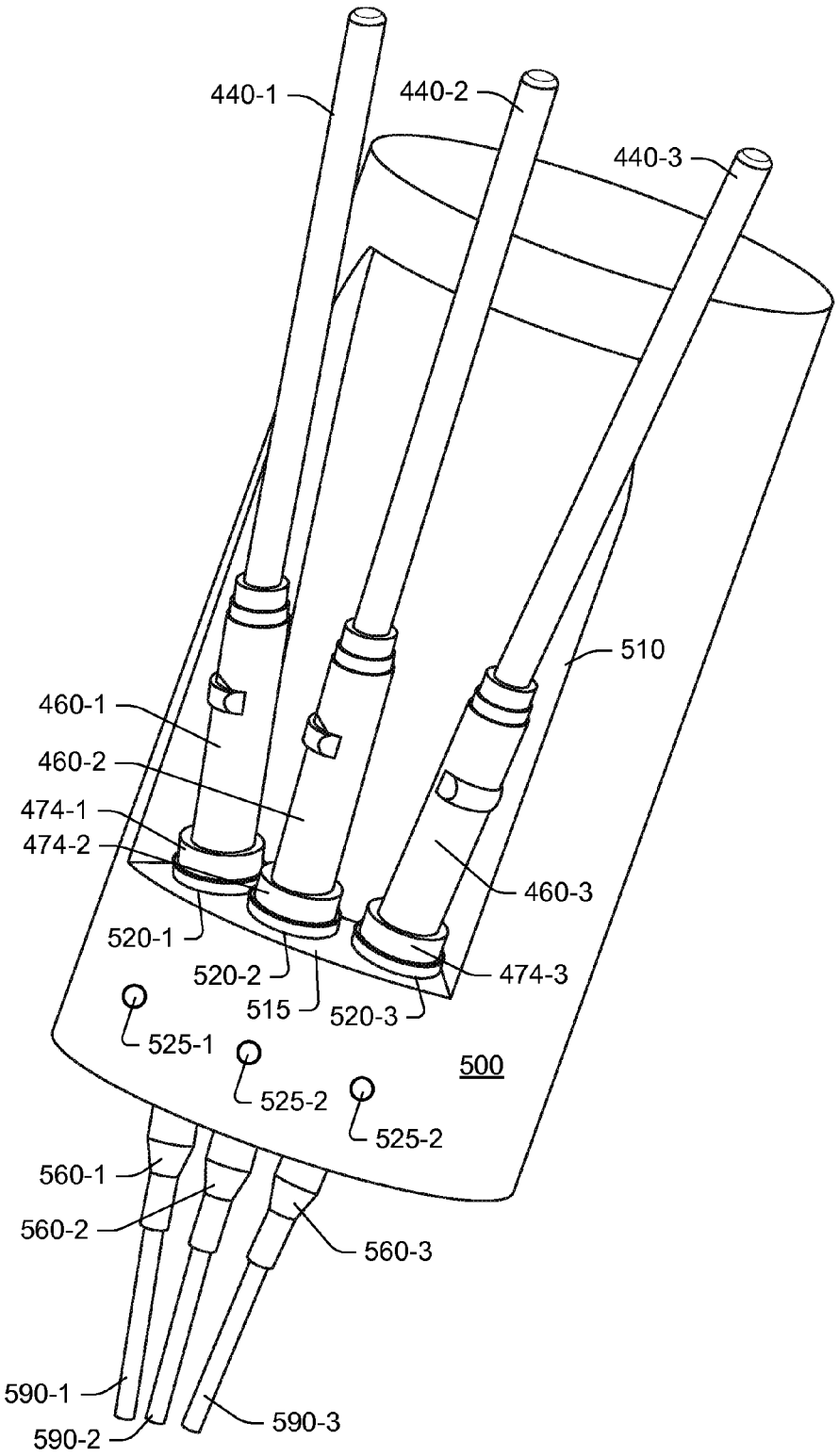
FIG. 4 illustrates an example of a connector head or housing for connecting one or more cables.
Figure 5:
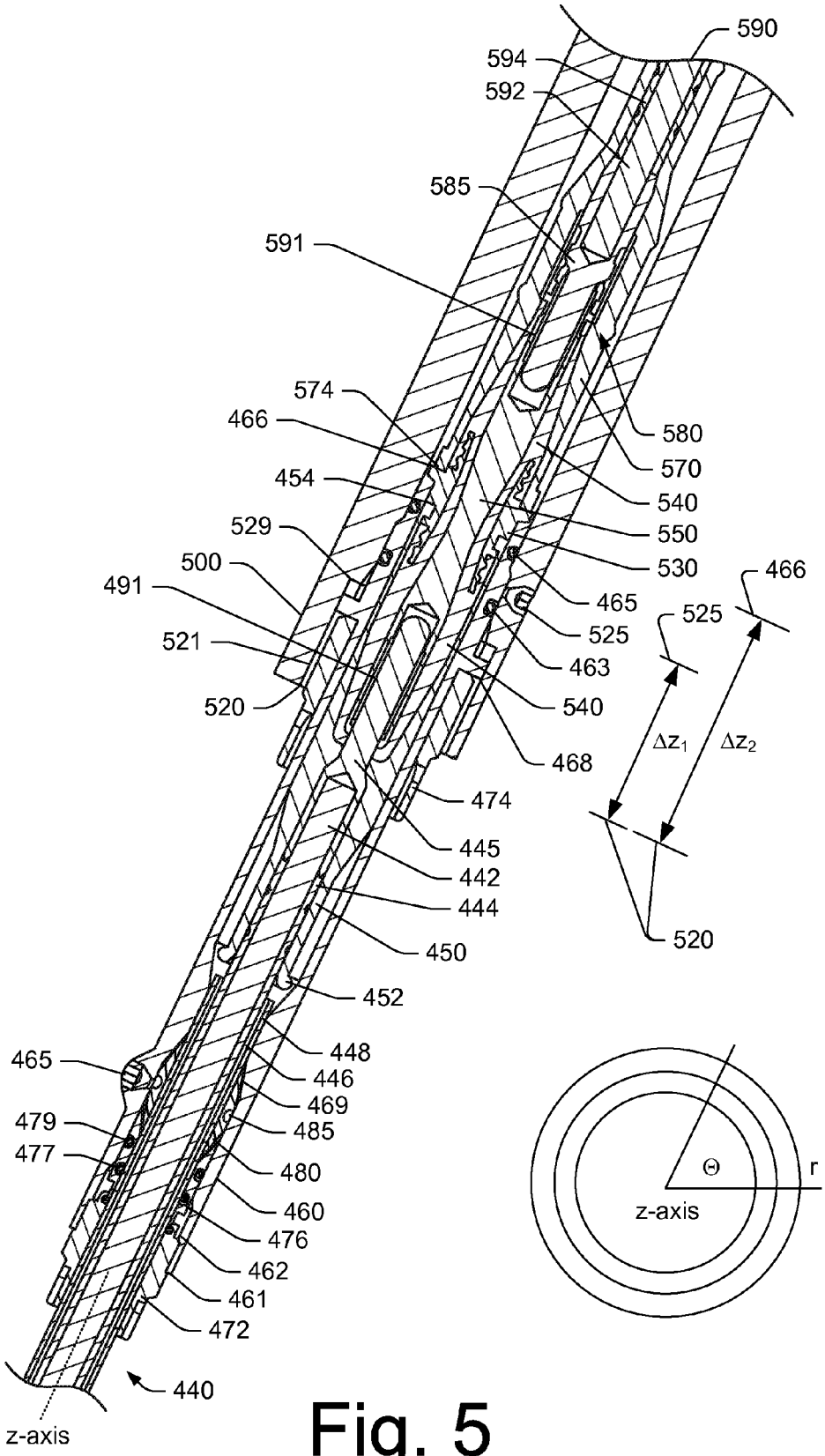
FIG. 5 illustrates an example of a cable connector assembly in a coupled state.
Figure 6:
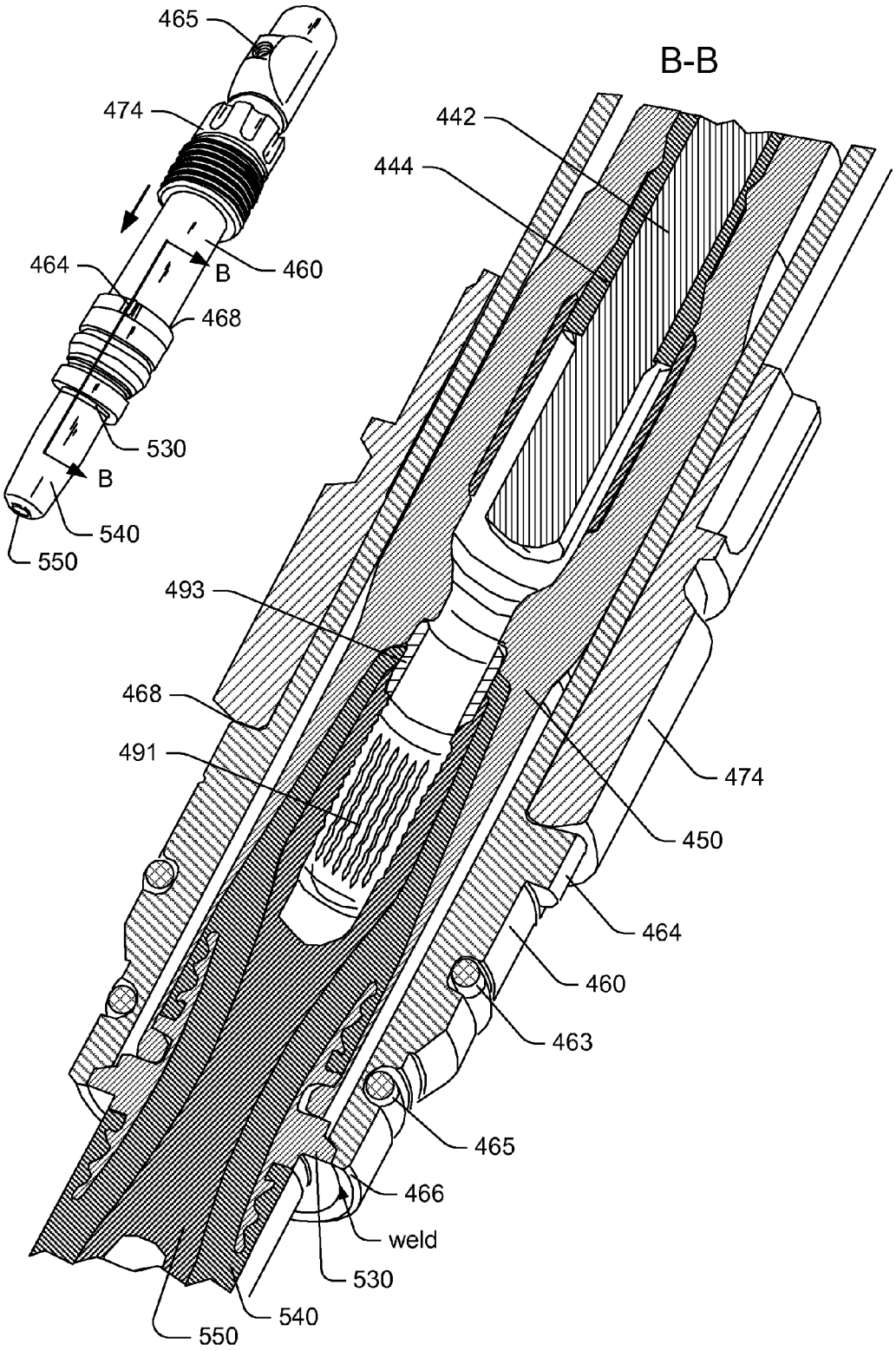
FIG. 6 illustrates a sub-assembly of the cable connector assembly of FIG. 5.
Figure 7:
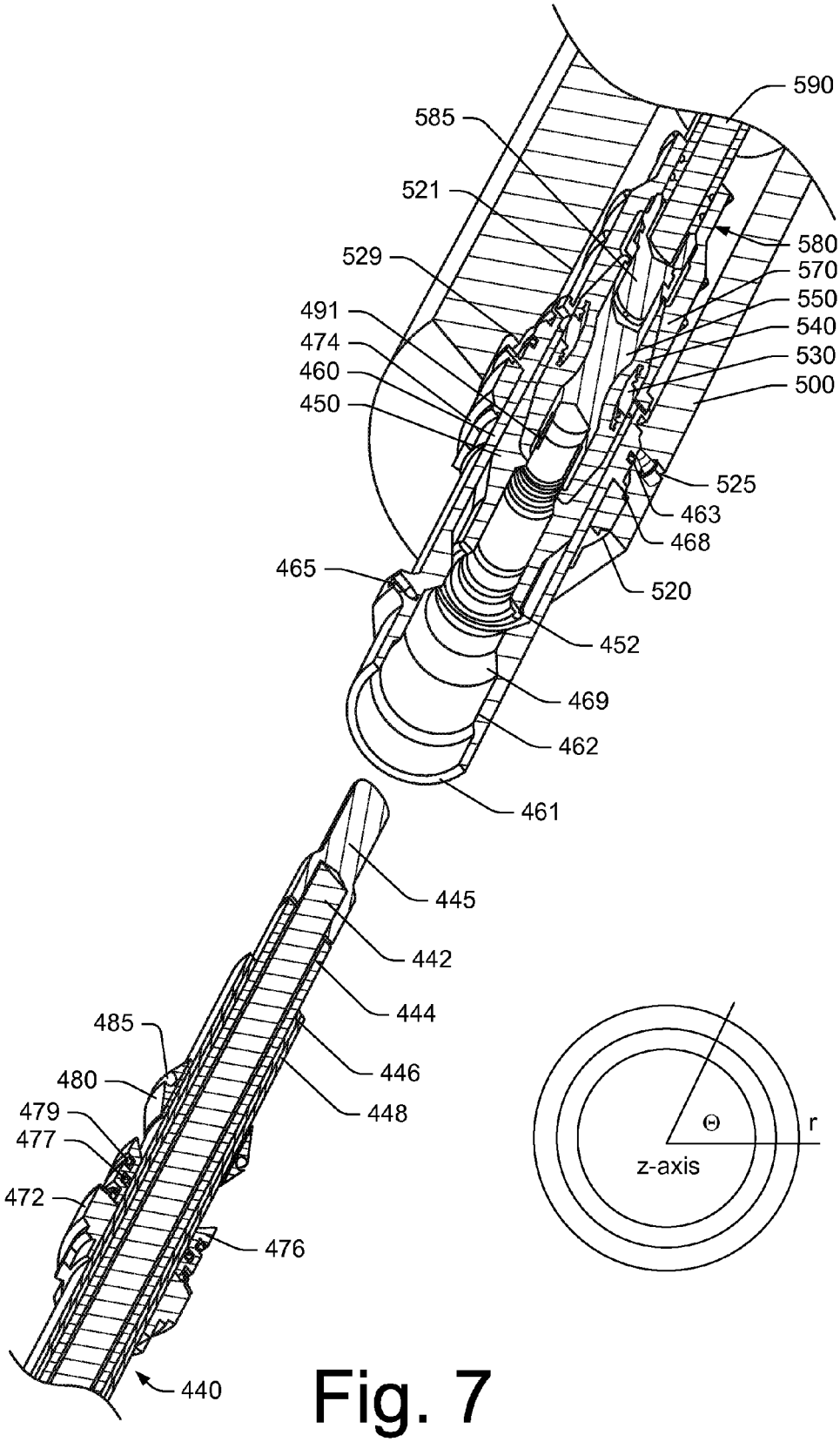
FIG. 7 illustrates the cable connector assembly of FIG. 5 in an uncoupled state.
Figure 8:
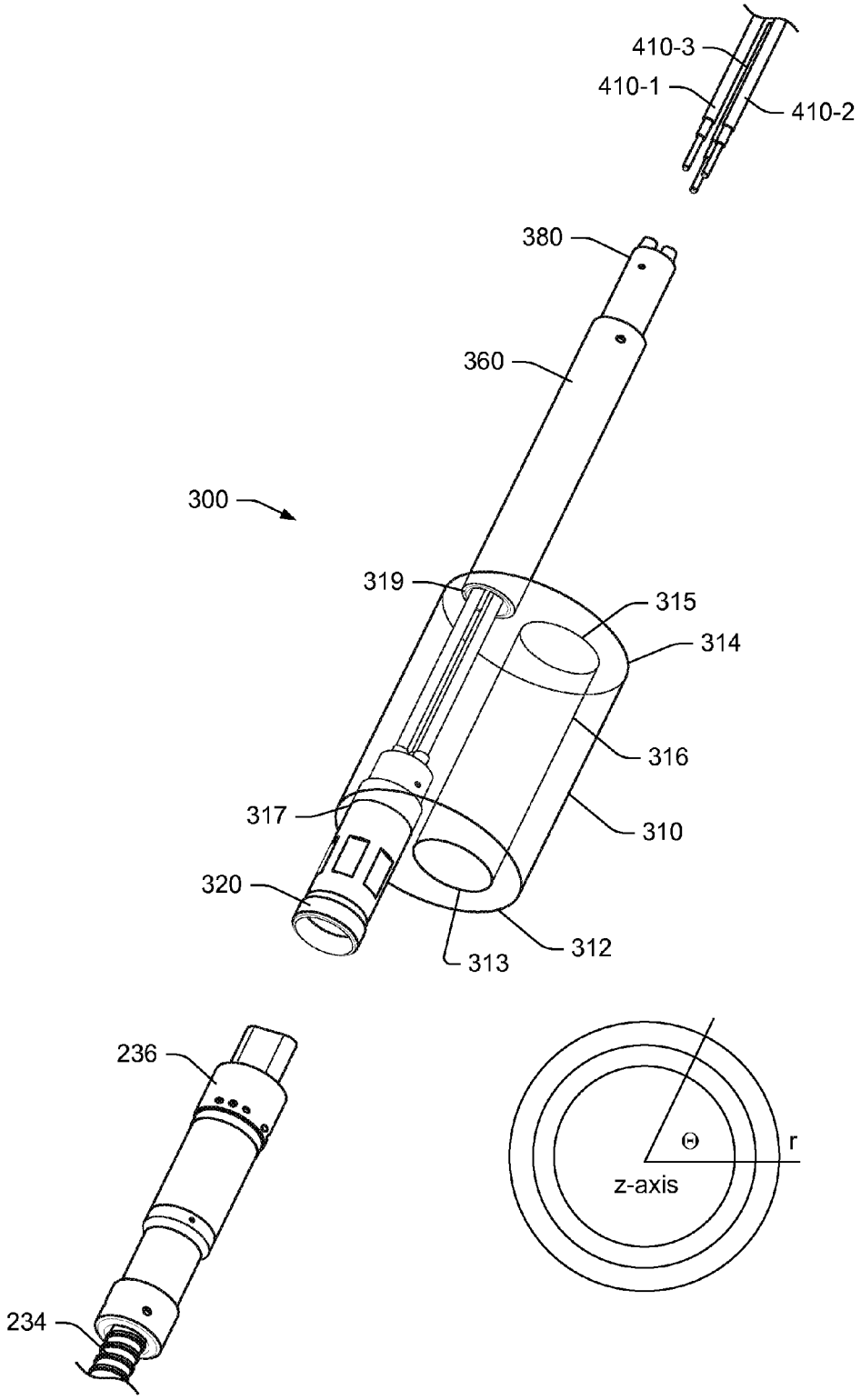
FIG. 8 illustrates an example of a cable connector assembly in an uncoupled state with respect to a packer.
Figure 9:
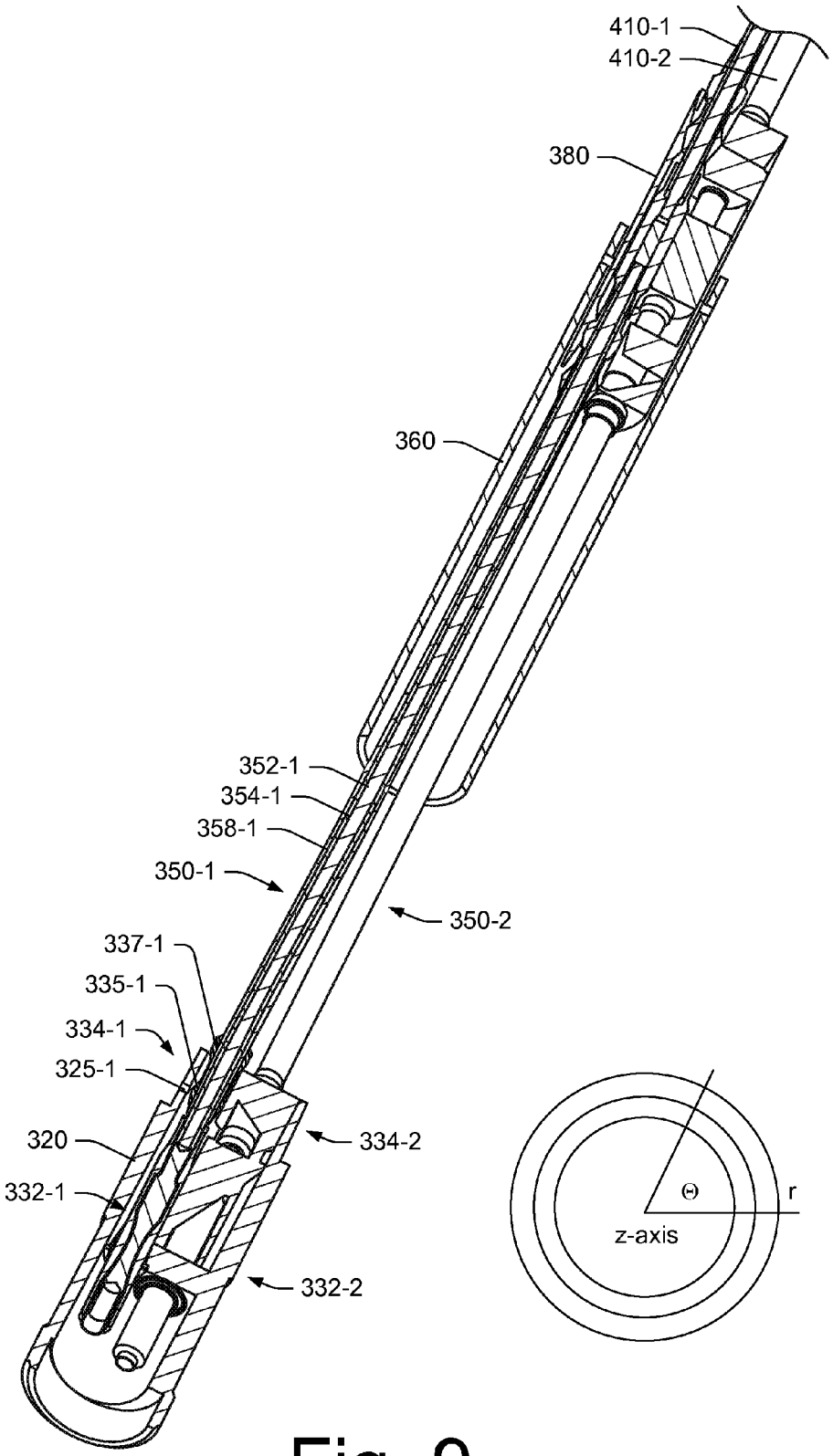
FIG. 9 illustrates a portion of the cable connector assembly of FIG. 8.
Figure 10:
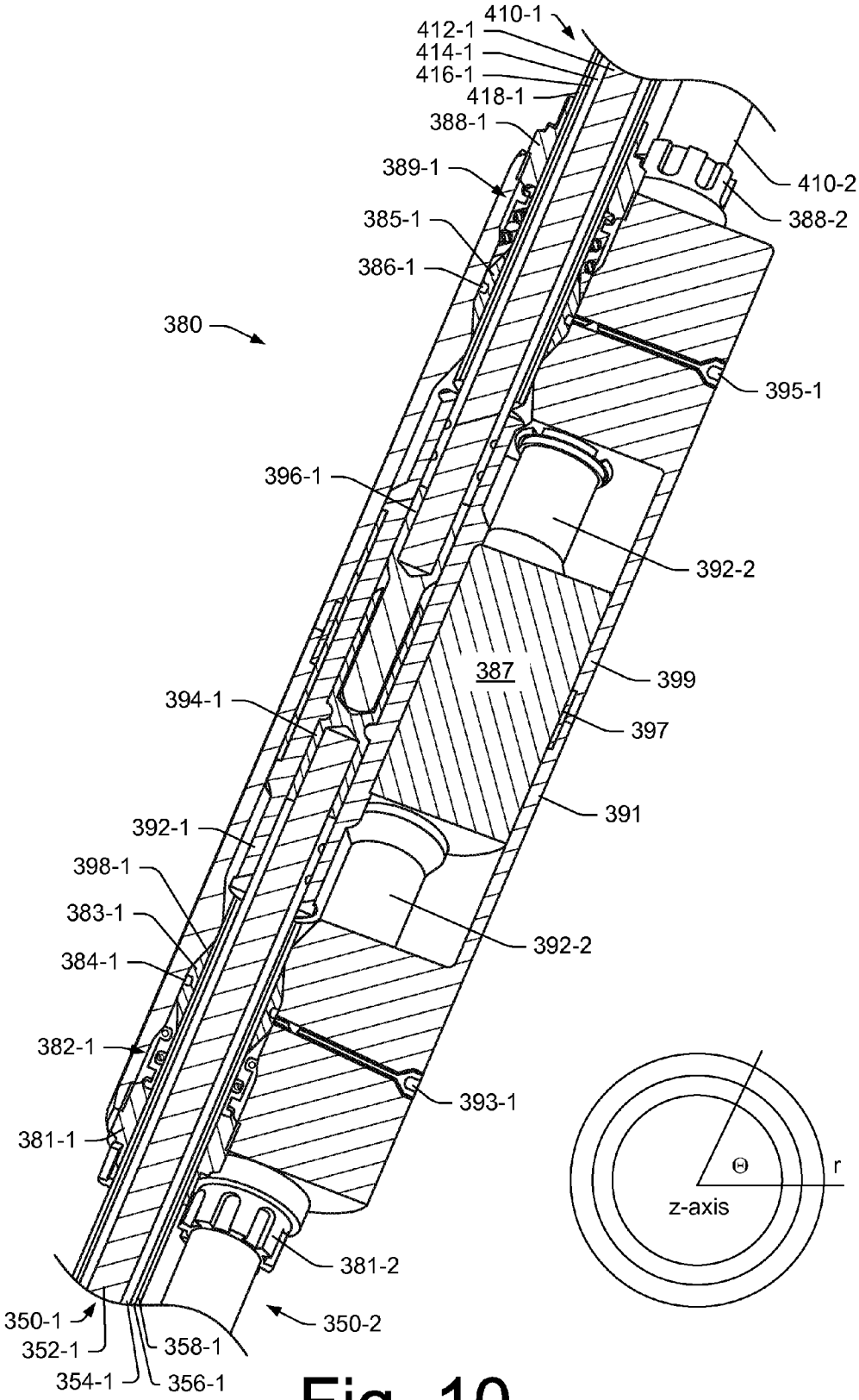
FIG. 10 illustrates a portion of the cable connector assembly of FIG. 8.
Figure 11:
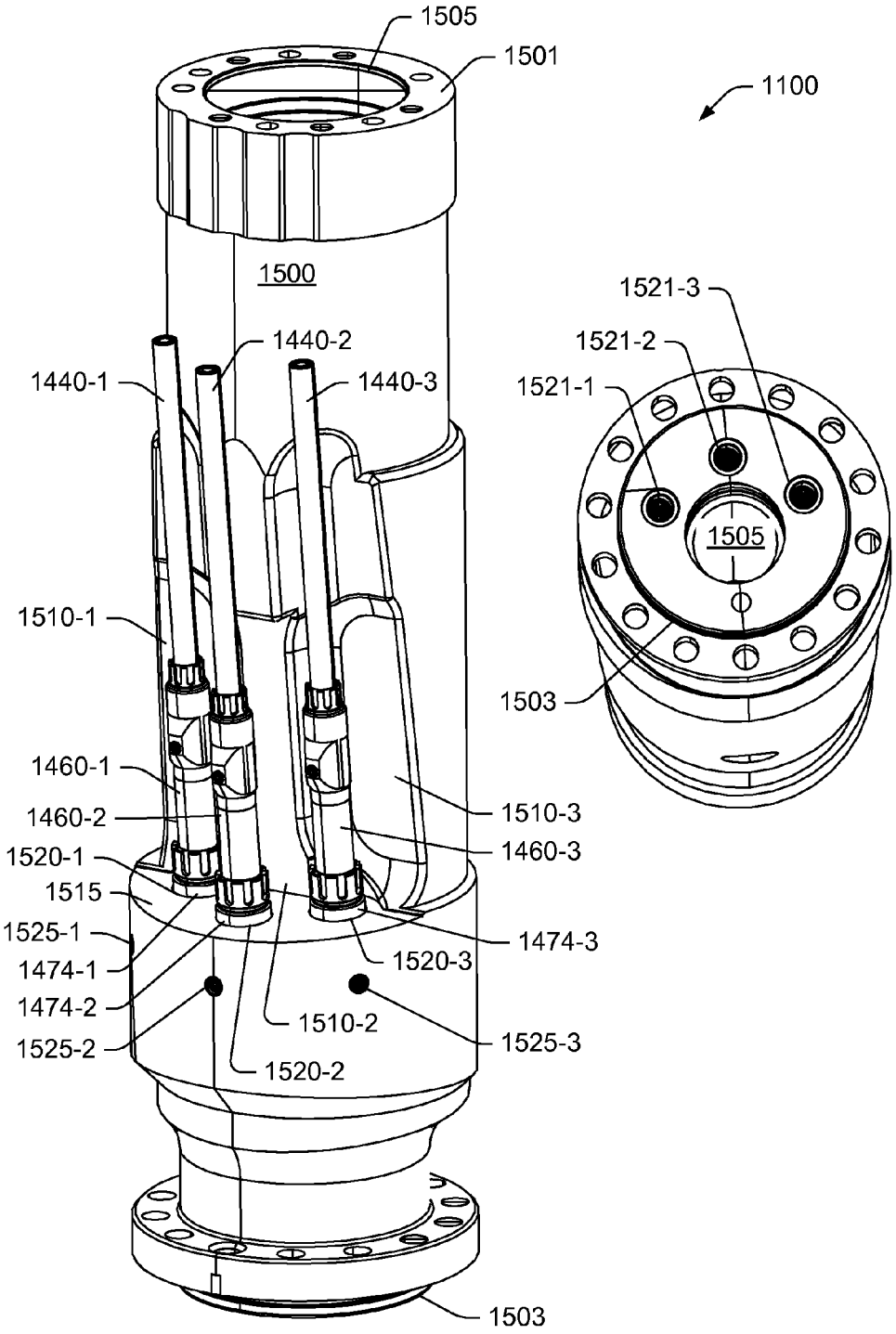
FIG. 11 illustrates another example of a cable connector assembly.
Figure 12:
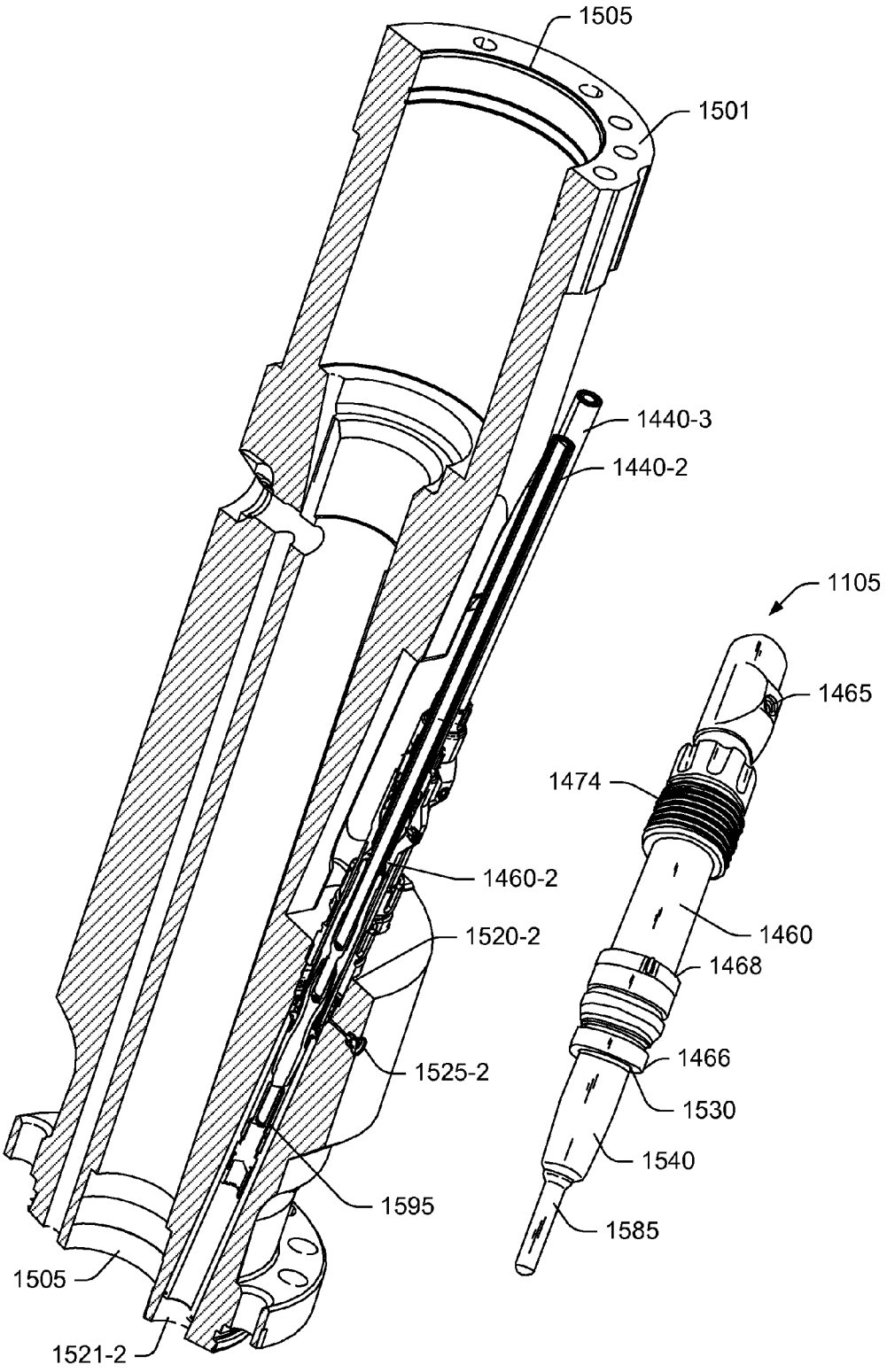
FIG. 12 illustrates the cable connector assembly of FIG. 11 and a sub-assembly thereof.
Figure 13:
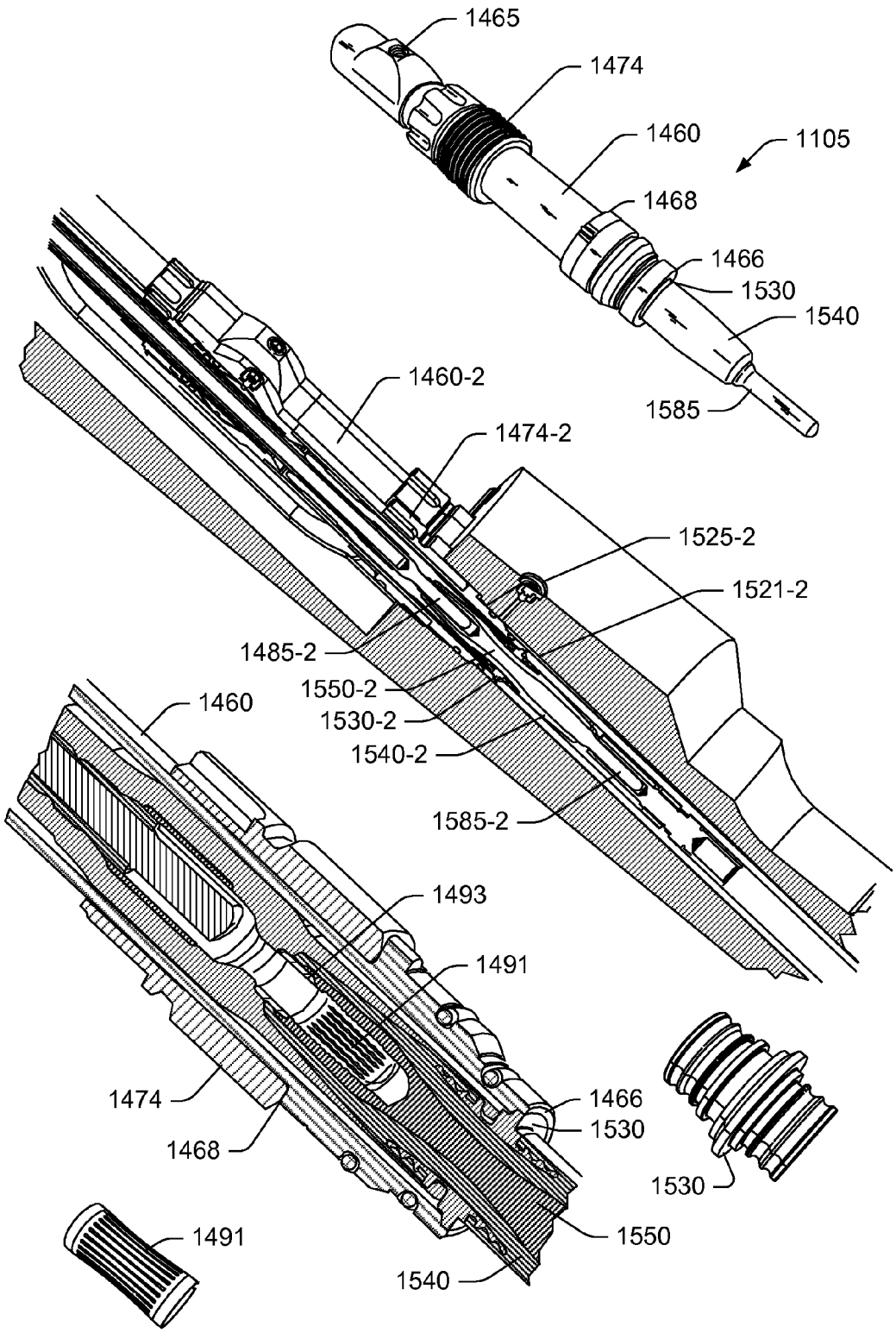
FIG. 13 illustrates a portion of the cable connector assembly of FIG. 11 and a sub-assembly thereof.
Figure 14:
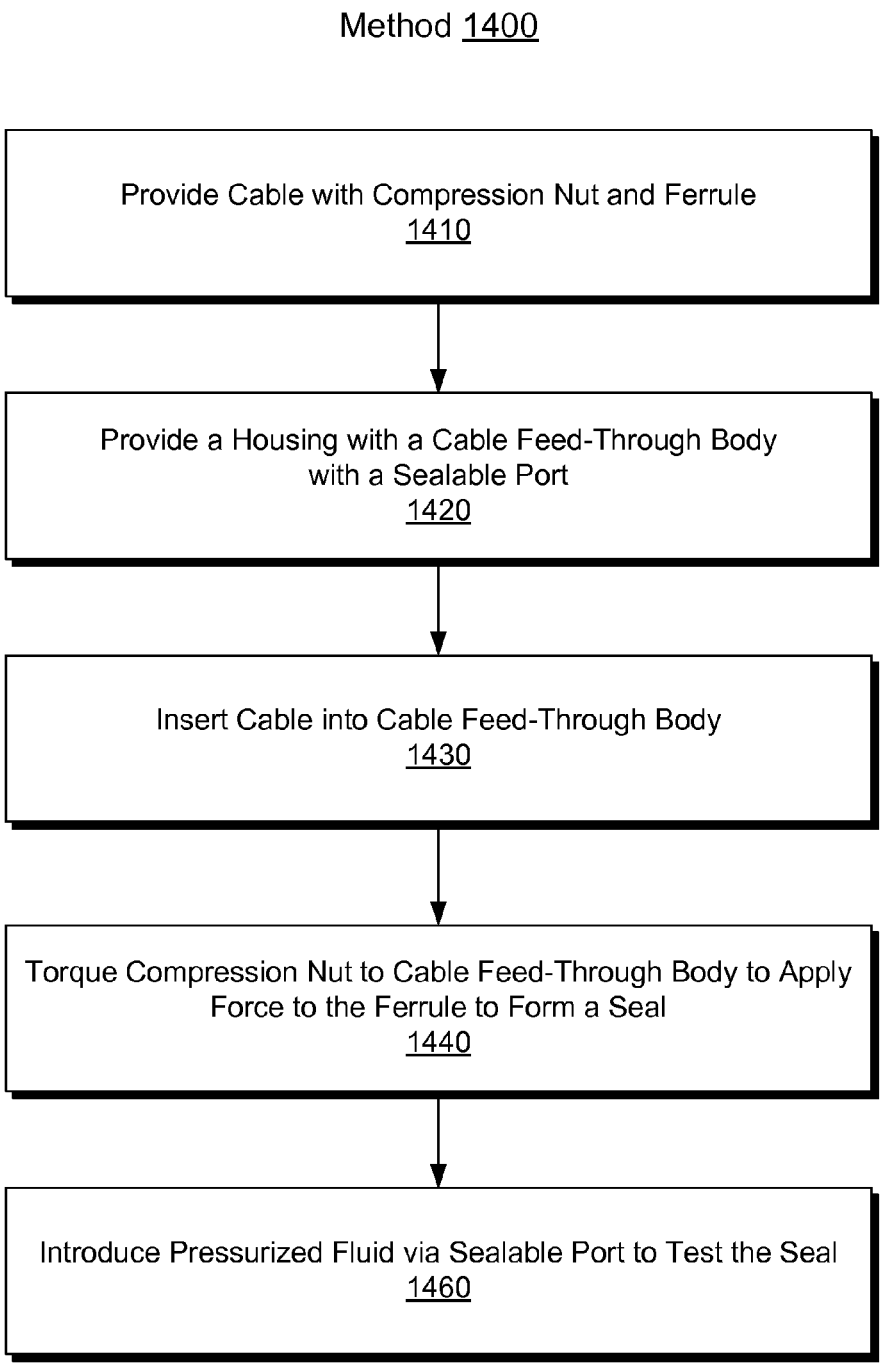
FIG. 14 illustrates an example of a method.

Various portions of the cable system 200 are described below. For example, FIG. 3 shows a detailed view of an individual cable 440, FIG. 4 shows an enlarged view of the penetrator block 500 and cable couplings, FIG. 5 shows a cross-sectional view of the individual cable 440 coupled via a coupling mechanism to the penetrator block 500, FIG. 6 shows a perspective view of a sub-assembly and a cut-away view thereof, FIG. 7 shows a cut-away view of the individual cable 440 prior to coupling to the penetrator block 500, FIG. 8 shows the packer feed-through assembly 300 in a decoupled state, FIG. 9 shows a cut-away view of a portion of the packer feed-through assembly 300 in a partially coupled state with respect to a lower splice or connection unit 380, and FIG. 10 shows a cut-away view of the lower splice or connection unit 380 of the packer feed-through assembly 300. FIGS. 11, 12 and 13 show another example of a penetrator block 1500 (e.g., a motor head block) and coupling mechanisms for coupling cables thereto. FIG. 14 show an example of a method 1400, for example, which may include use of various cables, assemblies, sub-assemblies, etc. described herein.

As mentioned, FIG. 3 shows an example of an individual cable 440, in a perspective view with various layers exposed and in a cross-sectional view along a plane having a line A-A. The cable 440 includes a conductor 442 (e.g., a conductive core), an insulator layer 444, a polymeric layer 446 (e.g., fluorinated ethylene propylene (FEP) as a copolymer of hexafluoropropylene and tetrafluoroethylene, tetrafluoroethylene (TFE), etc.) and a metal layer 448, which may be considered an outer jacket for the individual cable 440.

As an example, the metal layer 448 may be seam welded and then cold reduced onto a sub-assembly of the inner components 442, 444 and 446, for example, to trap and support them inside a tube formed by the metal layer 448. As an example, the formed metal layer 448 may resist external pressure and be made of a corrosion resistant material such as INCONEL® 625 alloy or 825 alloy (marketed by Specialty Materials Corporation, New Hartford, N.Y.) or a super duplex stainless steel (e.g., a duplex stainless steel). By cold reducing the metal layer 448, surface finish and seam weld may be sized within desired tolerances. As an example, additional surface polishing may also be carried out to achieve desired sealing surface characteristics.

As an example, the individual cable 440 may be assembled with one or more other cables in the form of a flat pack 441 or another form such as a circular pack 443. The flat pack 441 and the circular pack 443 may include one or more layers, for example, such as an armor outer shield layer.

As an example, the conductor 442 may be copper, which may be stranded or solid to convey voltage and current to a pump motor, a heater, etc. As an example, the insulator layer 444 may be provided directly over the conductor 442 and be made of a material such as, for example, FEP, PTFE, polyether ether ketone (PEEK, e.g., or another poly aryl ether ketone (PAEK) type of polymer), etc., to withstand operation voltage, system requirements, etc. The polymeric layer 446 may be provided directly on the insulator layer 444 and function as a bedding jacket, which may be fluted or ribbed to allow space for thermal expansion of the materials inside the metal layer 448. As an example, the polymeric layer 446 may provide a soft cushion between the insulation layer 444 and the metal layer 448, protecting the insulation layer 444 from internal defects or blemishes inside the metal layer 448, for example, such as seam weld beads or tubing cut end effects.

As an example, where the individual cable 440 is packaged with one or more other cables, they may optionally be encapsulated in a plastic extrusion (e.g., NYLON™ as marketed by E.I. du Pont de Nemours & Company, acetal, polypropylene etc.) or, for example, steel wrapped in a MONEL® alloy armor strip (MONEL® alloy marketed by Inco Alloys International, Inc., Huntington, W. Va.)

As mentioned, FIG. 4 shows the penetrator block 500 (e.g., a motor head for an ESP) for connecting one or more cables such as one or more of the cables 440-1, 440-2 and 440-3. In the example of FIG. 4, the block 500 includes a recess 510 with a lower surface 515 with three cable openings 520-1, 520-2 and 520-3, for example, with respective bores in the penetrator block 500. Below the openings 520-1, 520-2 and 520-3 are disposed three sealable ports 525-1, 525-2 and 525-3, which may, for example, connect to seal spaces within the penetrator block 500 for purposes of loading, testing, etc. by delivery of fluid (e.g., liquid, gas, etc.). As an example, pressure testing may be performed using a pressure differential of approximately 5,000 psi to approximately 10,000 psi, for example, depending on intended use, environmental conditions, etc.

In the example of FIG. 4, connectors may be dispersed around a motor head in a convenient manner so as to clear internal motor shafting and allow the outboard cable to flow freely into the feed-through (e.g., with minimal bend radius). As an example, the cables 440-1, 440-2 and 440-3 may enter straight to the cable openings 520-1, 520-2 and 520-3 (e.g., without bending with respect to the recess 510 of the penetrator block 500).

In the example of FIG. 4, the individual cables 440-1, 440-2 and 440-3 are coupled via respective components 460-1, 460-2, 460-3, 474-1, 474-2 and 474-3 that are at least partially received via respective ones of the cable openings 520-1, 520-2 and 520-3. As shown, the individual cables 440-1, 440-2 and 440-3 also couple with components 560-1, 560-2, 560-3, 590-1, 590-2 and 590-3. Various components shown in FIG. 4 are further illustrated and described with respect to FIGS. 5 and 6.

FIG. 5 shows an example of a cable connector assembly in a coupled state with respect to an individual cable 440 and an individual cable opening 520 of the penetrator block 500 (e.g., which may be part of a motor housing) where the opening 520 leads to a bore 521, which may include various radii, diameters, etc. over its axial length. A cylindrical coordinate system is shown as having a z-axis for the individual cable 440, the individual cable opening 520, the bore 521, etc. as well as radial and azimuthal dimensions r and Θ, respectively. As may be appreciated, any feature of the cable connector assembly may be defined, described, etc., with respect to the cylindrical coordinate system. For example, a sealable port 465 of a cable feed-through body 460 may be defined with respect to z, r and Θ coordinates, the sealable port 525 of the penetrator block 500 may be defined with respect to z, r and Θ coordinates, etc. Further, spatial relationships may be specified using z, r and Θ.

As shown in the example of FIG. 5, the cable feed-through body 460 may be fitted to the penetrator block 500 for receipt of the cable 440 via an opening in an end 461 of the cable feed-through body 460 where the opening in the end 461 leads to a bore 462 of the cable feed-through body 460, which may include a bore surface of varying radii, diameter, etc. over its axial length. In such an example, the cable 440 can include various components fitted thereto prior to insertion into the cable feed-through body 460. For example, to form a gland seal with the cable feed-through body 460, the cable 440 may be fitted with a bushing 472 with a rolled section, a bushing 476 that seats seal elements 477 and 479 to which the rolled section of the bushing 472 may physically grip, and a ferrule 480 that includes an annular groove 485, for example, which may allow for some amount of deformation of the ferrule 480 and to allow for fluid communication in approximately a 360 degree manner (consider test fluid introduced via a port 465 in the cable feed-through body 460). As an example, the rolled section of the bushing 472 may allow for extraction of the bushing 476 via a gripping force that the bushing 472 applies to the bushing 476. Further, as shown, the metal layer 448 and the polymeric layer 446 of the cable 440 terminate at an axial point beyond which the insulation layer 444 extends covering the conductor 442. Yet further, the insulation layer 444 terminates at another axial point beyond which the conductor 442 extends axially. As shown, a contact pin 445 includes a cylindrical wall forming socket in which an end of the conductor 442 is received and fixedly attached, for example, by crimping of the cylindrical wall of the contact pin 445 or by another attachment technology.

As shown in the example of FIG. 5, a gland seal is formed at least in part by the bushing 476 and the ferrule 480 that surround the metal layer 448 of the cable 440, which form seals with an inner surface of the cable feed-through body 460, for example, in part via the seal elements 477 and 479. As an example, the bushing 472 may be a gland compression nut adjustable to a specified torque value to apply an axial compression force directly against the bushing 476 that may be transferred to the ferrule 480, which includes a tapered outer diameter fit within a tapered bore surface 469 of the cable feed-through body 460 (e.g., where the tapered bore surface 469 forms a neck in the bore 462). Where the ferrule 480 is made of metal and the cable feed-through body 460 is made of metal, a metal-to-metal-to-metal compression seal may be formed by the ferrule 480 against the tapered bore surface 469 of the cable feed-through body 460 and against an outer surface of the metal layer 448 of the cable 440.

As shown in FIG. 5, the metal layer 448 and the polymeric layer 446 of the cable 440 terminate at a termination point located axially past the tapered bore surface 469 (e.g., and the neck extending therefrom) in the bore 462 of the cable feed-through body 460. The various seals formed axially above the termination point of the metal layer 448 and the polymeric layer 446 act to prevent environmental fluid intrusion and contact with the exposed insulation layer 444, which extends axially toward the cable opening 520 past the termination point.

As shown, the sealable port 465 is located radially outwardly from the ferrule 480. The various seal elements 477 and 479 in conjunction with compression seal interfaces formed by the ferrule 480, as seated with respect to the various components forming the gland seal, may be tested via the sealable port 465, for example, by introducing a non-corrosive test fluid (e.g., liquid, gas, etc.) with a desired amount of fluid pressure (consider pressure in a range of approximately 5,000 psi to approximately 10,000 psi).

As shown in the example of FIG. 5, the insulation layer 444 and the conductor 442 of the cable 440 are received by via an opening at an end 452 of an elastomeric coupling component 450 disposed within the cable feed-through body 460. The end 452 of the coupling component 450 may be an end of a tubular sleeve portion of the coupling component 450, which, formed of an elastomeric material, may be stretched to form a pressure fit latching seal over a portion of the cable 440. As an example, the tubular sleeve portion of the coupling component 450 may include surface features (e.g., bumps, ribs, gripping prongs, etc.) that may intrude radially into the insulation layer 444 of the cable 440. As an example, the coupling component 450 may be made of a material such as a rubber, synthetic rubber (e.g., VITON® synthetic rubber as marketed by E.I. du Pont de Nemours & Company, Wilmington, Del.), silicon rubber, EPDM (e.g., where The E refers to ethylene, P to propylene, D to diene and M refers to a classification in ASTM standard D-1418; e.g., ethylene copolymerized with propylene and a diene), etc. As shown, the coupling component 450 receives and houses the contact pin 445, which, as mentioned, may be crimped or otherwise attached to a portion of the conductor 442 that extends axially beyond a termination point of the insulation layer 444 of the cable 440. As shown, the contact pin 445 extends from the conductor 442 of the cable 440 and axially into the opening 520 of the penetrator block 500 where it joins another coupling structure 540 that includes a coupling conductor 550.

In the example of FIG. 5, the coupling structure 540 is made of an insulator that partially surrounds the coupling conductor 550. The coupling conductor 550 includes one end opening for receipt of the contact pin 445 as attached to the conductor 442 of the cable 440 and another end opening for receipt of another contact pin 585 as attached to another conductor 592 of another cable 590. In the example of FIG. 5, a contact band 491 is shown as being disposed between the contact pin 445 and the coupling conductor 550 and another coupling band 591 is shows as being disposed between the contact pin 585 and the coupling conductor 550. As an example, one or both of the contact bands 491 and 591 may be louvered. As an example, one or both of the contact bands 491 and 591 may be made of copper and optionally copper and beryllium. As an example, one or both of the contact bands 491 and 591 may be gold plated (consider, e.g., gold plating on a band that include copper and beryllium). As an example, a band 1493 (e.g., a securing band) may be received at an end of the coupling structure 540, for example, to help secure the contact pin 485 and to retain the contact band 491 within the coupling conductor 550; noting that a such as the band 493 may be provided for the other end of the coupling structure 540.

In the example of FIG. 5, between the end openings, the coupling conductor 550 includes a neck about which the coupling structure 540 and a bushing 530 are disposed where the bushing 530 may assist with axially locating the coupling structure 540 in the bore 521 of the housing 500. As shown, the bushing 530 is received by the coupling structure 540 and is disposed between an end 466 of the cable feed-through body 460 and an end 574 of a coupling component 570 for the cable 590. As shown, an end 454 of the coupling component 450 terminates axially at the bushing 530, which may include a shape to help relieve electrical stresses (e.g., which may occur as current flows in the cable 440). As an example, the bushing 530 can include axial extensions and a collar portion disposed therebetween, which, for example, may be welded to the end 466 of the cable feed-through body 460 (consider, e.g., electron beam welding to secure the bushing 530 at least partially in an opening of the end 466 of the cable feed-through body 460).

In the example of FIG. 5, the coupling component 450 and the coupling component 570 may be configured to form a boot seal (e.g., or boot seals). As shown, a tubular sleeve portion of the coupling component 570 may latch to an insulation layer 594 of the cable 590 at one end (see, e.g., description of the coupling component 450) and receive the coupling structure 540 at another end. Similarly, as mentioned, the coupling component 450 can include a tubular sleeve portion that may latch to the insulation layer 444 of the cable 440 at one end and receive the coupling structure 540 at another end. As an example, symmetry may exist about a center r,Θ-plane of the coupling structure 540, for example, for receipt of the contact pin 445 at one end and for receipt of the contact pin 585 at another end (e.g., where the coupling structure 540 includes two female sockets for receipt of respective male pins) or, for example, in another arrangement of sockets and pins.

As an example, the coupling structure 540 may include one or more features of a contact pin assembly described in US Patent Application Publication No. US 2009/0047815 A1, which is incorporated by reference herein (inventor Nicholson and assignee Schlumberger Technology Corporation). For example, the '815 publication describes an integrally-molded stress control collar. As an example, the bushing 530 may be or include a stress control collar. As mentioned, welding such as electron beam (EB) welding may be applied to connect the bushing 530 to the cable feed-through body 460.

Referring again to the cable opening 520 in the penetrator block 500, it includes an internal shoulder 529 disposed at an axial depth to form a bore with a cross-section sufficient to accommodate a shoulder 468 of the cable feed-through body 460, which also seats a bushing 474, which may be threaded, for example, to engage threads of the penetrator block 500 and to lock the cable feed-through body 460 thereto. As shown, the cable feed-through body 460 includes an annular seat (e.g., a groove, etc.) to seat a seal element 463 just prior to an axial position of the sealable port 525 of the penetrator block 500. As an example, fluid may be introduced at a desired pressure via the sealable port 525 to test a seal formed by the seal element 463, for example, to determine risk of environmental fluid entering via the cable opening 520 and passing via the bushing 474, the shoulder 468 and the seal element 463. Also shown in the example of FIG. 5 is another seal element 465 disposed in another annular seat (e.g., a groove, etc.) of the cable feed-through body 460. Disposed between the two seal elements 463 and 465, the cable feed-through body 460 includes a tapered surface that may form a metal-to-metal compression seal against a tapered surface of the bore 521 of the penetrator block 500 (e.g., motor head, etc.). In such an example, the bushing 474 may be torqued to apply axial force sufficient to form a seal between the tapered surfaces (e.g., a metal-to-metal cone seal, etc.). As an example, the sealable port 525 may be used to test such a seal as well as seals formed by the seal elements 463 and 465. As an example, multiple seal elements may be disposed, for example, in an annular seat, a spring seal may be seated in an annular seat, etc. For example, rather than the single seal element 465, multiple seal elements may be used, a spring seal may be used, etc. As the penetrator block 500 may be part of a housing such as a motor housing, the gland type of seal formed by the various features aim to avoid such fluid leakage as the fluid may damage or otherwise impair operation of one or more components housed within the housing (e.g., or connected thereto).

FIG. 6 shows a perspective view and a cut-away view (along a line B-B) of a sub-assembly that includes the cable feed-through body 460 as well as the coupling component 450, the bushing 530, the coupling structure 540 and the coupling conductor 550 disposed therein. Also shown in FIG. 6 is a locating key 464, for example, to help ensure proper orientation of the cable feed-through body 460 when it is inserted into an opening of a penentrator block (e.g., the block 500, a motor head, etc.).

In the perspective view, the bushing 474 is translatable in an axial direction along the cable feed-through body 460, for example, to contact the shoulder 468 from which the locating key 464 extends radialy outwardly therefrom. As indicated, the cut-away view is along a plane with a line B-B. To more clearly illustrate an example of the contact band 491, the cut-away view is shown without the contact pin 445 (e.g., the end of the conductor 442 of the cable 440 is shown along with its insulator layer 444 as latched by the tubular sleeve portion of the coupling component 450). Also shown in FIG. 6 is an arrow at a joint between the bushing 530 and the cable feed-through body 460 to indicate a region where a weld may be made such as, for example, an electron beam weld to secure the bushing 530 to the cable feed-through body 460. As shown, the bushing 530 includes axial extensions that extend into the coupling structure 540 where, for example, a rimmed end of the coupling component 450 may also be secured in a groove of the bushing 530.

FIG. 6 also shows the seal elements 463 and 465 as being disposed in respective grooves of the cable feed-through body 460. Between these grooves, the cable feed-through body 460 includes a tapered surface, for example, disposed between an annular surface of a first diameter and an annular surface of a second, smaller diameter. As mentioned, such a tapered surface may be compressed against a surface in a bore of a penetrator block, housing, etc., for example, to form a cone seal (e.g., a metal-to-metal cone seal). In such an example, a sealable port may provide for introduction of fluid under pressure to test the integrity of the cone seal (e.g., where the sealable port provides for fluid communication to a region disposed between the seal elements 463 and 465 as disposed in a bore of a penetrator block, a housing, etc.

FIG. 7 shows the example cable connector assembly of FIG. 5 in an uncoupled state. As shown, the cable feed-through body 460 is received by the cable opening 520 and attached to the penetrator block 500. In the uncoupled state, seals within the penetrator block 500 and the cable feed-through body 460 are formed and optionally testable via the sealable port 525. To transition to the coupled state of FIG. 5, the cable 440 with various components attached thereto (e.g., bushings, seal elements, contact pin, etc.) may be inserted into the bore 462 of the cable feed-through body 460 via the opening at the end 461 of the cable feed-through body 460 such that the contact pin 445 contacts the coupling conductor 550 to electrically couple the cable 440 to the cable 590, for example, via the coupling conductor 550 also being coupled to the contact pin 585. As shown, such contacts may occur, in part, via the contact band 491 and the contact band 591.

As an example, a cable coupling assembly may include a coupling conductor (see, e.g., the coupling conductor 550) formed of gold plated copper for low contact resistance and high current transmission. As an example, such a coupling conductor may be molded in an insulating material such as PEEK (e.g., or other poly aryl ether ketone (PAEK) type of polymer) together with a stress control ring (see, e.g., the aforementioned '815 publication). For example, the coupling structure 540 may be made of an insulating material and the bushing 530 may be provided as a stress control ring.

As an example, a sub-assembly that includes a cable feed-through body may be fitted with a first boot seal for receipt of a power cable and a second boot seal for receipt of a cable such as a motor cable (e.g., or heater cable, etc.). As an example, the first boot seal and the second boot seal may receive a respective end of a bonded brass tube (see, e.g., the coupling conductor 550) where each end can lock a contact pin crimped to a conductor of a cable such as a motor cable (e.g., or heater cable, etc.). As an example, the cable feed-through body 460 may be fitted with such features (e.g., consider the coupling components 450 and 570 as each receiving an end portion of a bonded brass tube that can lock a contact pin).

As an example, a contact pin (see, e.g., the pins 445 and 585) may be crimpable to form crimp contacts and, for example, made of copper and gold plated for low contact resistance and to prevent oxidation.

As an example, a cable feed-through body may be electron beam welded into position, for example, to provide a sealed coupling unit for coupling of a cable (e.g., a power cable).

As an example, a metal cone seal feature may be provided at a seal interface to a penetrator block (e.g., or housing). As an example, a seal may be provided as another type of metal seal such as a C seal or spring seal. As mentioned, a sealable port may be a test port to allow pressure tests to be performed at a penetrator block interface for seal verification. For example, the cable feed-through body 460 may form a metal cone seal with an inner surface of a bore in the penetrator block 500. In such an example, the seal element 463 may form a seal at an axial location between the shoulder 468 (e.g., or flange) of the cable feed-through body 460 and the sealable port 525 of the penetrator block 500, which provides a fluid communication passage to the bore in the penetrator block 500.

As an example, the cable feed-through body 460 of FIG. 7 as fitted to the penetrator block 500 may be provided with a tamper proof cap (e.g., plastic or other material) to prevent water and contamination entry. For example, the end 461 of the cable feed-through body 460 may be fitted with a cap (e.g., to cover the bore 462). As an example, a motor cable for a motor may be pre-terminated with a contact pin via crimping contact and a gland compression seal swaged onto the motor cable (e.g., set to the correct length using a swaging tool). In such an example, termination tasks required on site may be minimized, for example, such that an operator merely inserts a cable into a respective cable feed-through body and torques a gland compression nut (see, e.g., the bushing 472) to a specified torque value (e.g., to apply an axial compression force at interfaces between the ferrule 480 and the cable 440 and the ferrule 480 and the cable feed-through body 460).

As shown in FIGS. 5, 6 and 7, a cable connector assembly may include two gland seals, each with a sealable port, for example, for testing seal integrity. While such gland seals may include one or more seal elements, which may be made from a non-metallic material, the gland seals include metal-to-metal contacts that form sealing interfaces. As an example, one of the gland seals may be provided for the assembly in a decoupled state while the other gland seal is formed upon coupling to a coupled state and torqueing of a compression nut. In such an example, two conductors may be electrically coupled and sealed via an insertion operation and a torqueing operation, optionally followed by a pressurized fluid testing operation to test one gland seal or optionally pressurized fluid testing operations to test both gland seals.

FIG. 8 shows the cable connector assembly 300 in an uncoupled state with respect to a packer 310. As shown in the example of FIG. 8, the packer 310 includes opposing ends 312 and 314 that include openings 313 and 317 and 315 and 319, respectively. Disposed between the openings 313 and 315 is a bore 316, which may be for flow of fluid (e.g., production, injection, etc.). For example, a pump located downhole from the packer 310 may produce a fluid that flows through the bore 316 of the packer 310 (e.g., for receipt at an uphole location).

A cylindrical coordinate system is shown in FIG. 8 as having a z-axis for the individual cable 440, for a coupling structure, etc. as well as radial and azimuthal dimensions r and Θ, respectively. As may be appreciated, any feature of the cable connector assembly may be defined, described, etc., with respect to the cylindrical coordinate system.

As to the openings 317 and 319 of the packer 310, they provide for mounting of a receptacle 320 and an extension tube 360 for a connection unit 380. Collectively, these components may be referred to as a packer penetration feed-through assembly. As an example, with reference to FIG. 2, the cable connector assembly 300 may receive via the receptacle 320 a plug 236 for one or more conductors and may receive via the connection unit 380 one or more cables 410 to be electrically coupled to the one or more conductors associated with the plug 236. In the example of FIG. 8, the cable connector assembly 300 is configured for electrically connecting three conductors associated with a cable pack 234 coupled to the plug 236 to three conductors associated with individual cables 410-1, 410-2 and 410-3, which may be bundled or formed into a single pack (see, e.g., the flat pack 441 and the circular pack 443 of FIG. 3).

FIG. 9 shows a cut-away view of a portion of the assembly 300 of FIG. 8. Specifically, FIG. 9 shows various components of the packer penetration feed-through assembly from the receptacle 320 to the extension tube 360 and the connection unit 380, which is connected to at least the cables 410-1 and 410-2. The cut-away view of FIG. 9 provides a cross-sectional view of a coupling path for the cable 410-1 and a perspective view of a coupling path for the cable 410-2.

The receptacle 320 includes a gland seal 334-1 with an associated sealable port 325-1 as well as a coupling structure 332-1. The gland seal 334-1 may be formed in part by a ferrule 335-1 that may receive an axial compression force via torque applied to a compression nut 337-1 fitted to a metal layer 358-1 about a conductor 352-1, which may include an insulator layer 354-1 and, for example, an elastomer layer disposed between the insulator layer 354-1 and the metal layer 358-1. As an example, the ferrule 335-1 may include an annular groove that may provide for fluid communication about the ferrule 335-1, some amount of deformation of the ferrule 335-1, etc. (see, e.g., the ferrule 480 of FIGS. 5, 6 and 7).

As an example, pressure sealing across the packer 310 may be achieved in part by using a 3 phase dry-mateable electrical connector (DMEC) receptacle as the receptacle 320, for example, which may be secured and sealed with respect to the opening 313 at the end 312 of the packer 310, for example, using a line pipe or national pipe thread (NPT) taper seal or, for example, with labyrinth O seals (e.g., O-rings), metal seals, etc.

To prevent potential gas migration through the receptacle 320, a packer connector may include components that form a gas barrier at a contact pin interface, for example, via the aforementioned gland seal. For example, such components may include the ferrule 335-1 and the compression nut 337-1 along with the sealable port 325-1 for integrity testing of the formed gland seal. As an example, one or more components may be electron-beam welded, optionally without O seals, which may fail under explosive decompression (ED).

As an example, an individual cable 350-1 or 350-2 that extends through the packer 310 may be constructed according to the examples of FIGS. 3, 5 and 7 in that it includes an outer metal layer. Sealing about the outer metal layer may be achieved, at least in part, via metal-to-metal contact using a gland compression seal that may be testable.

As an example, packer penetration feed-through assembly may be assembled into the packer 310 to form an integrated assembly prior to being shipped to the field.

As an example, an assembly can include a housing that includes an opening, a bore extending from the opening along an axis and a sealable port in fluid communication with the bore and disposed at an axial distance from the opening (see, e.g., axial distance $\Delta z_1$ in FIG. 5); and a cable feed-through body that includes a first axial end, a second axial end, a bore extending between the axial ends, a tapered bore surface and a sealable port, the cable feed-through body being partially disposed within the bore of the housing to locate the second axial end at an axial distance from the opening of the housing (see, e.g., axial distance $\Delta z_2$ in FIG. 5) that exceeds the axial distance of the sealable port of the housing to at least in part form a gland seal between the cable feed-through body and the bore of the housing, the gland seal being testable by introduction of fluid via the sealable port of the housing. In such an example, the cable feed-through body can include a seal element mounted thereto, the seal element being disposed axially between the opening and the sealable port of the housing. In such an example, the cable feed-through body can include a tapered surface that forms a seal interface with a tapered surface of the bore of the housing, the seal interface being disposed axially between the sealable port and an axial end of the cable feed-through body (e.g., the axial end received by the housing).

As an example, an assembly can include a coupling structure disposed in a bore of a housing and partially in a bore of a cable feed-through body via an axial end of the cable feed-through body. In such an example, the coupling structure can include a coupling conductor for electrically coupling a conductor of a cable disposed in the bore of the cable feed-through body to another conductor. As an example, the other conductor may be a motor conductor or a heater conductor (e.g., or yet another type of conductor). As an example, an assembly may include a bushing for locating a coupling structure in a bore of a housing.

As an example, an assembly may include a coupling component disposed in a bore of a cable feed-through body where the coupling component includes a sleeve end for latchable receipt of a conductor of a cable and an opposing end that receives an axial length of a coupling structure for electrically coupling the conductor of the cable to a coupling conductor of the coupling structure.

As an example, an assembly may include a cable, a compression nut and a ferrule where a portion of the cable and the ferrule are disposed in a bore of a cable feed-through body and where the compression nut is attached to the cable feed-through body to apply a compressive force between the ferrule and a tapered bore surface of the cable feed-through body to at least in part form a gland seal where, for example, the gland seal may be testable by introduction of fluid via a sealable port of the cable feed-through body.

As an example, an assembly may include a contact pin disposed on a conductor of a cable. In such an example, an assembly may include a coupling structure disposed in a bore of a housing and partially in a bore of a cable feed-through body via an axial end of the cable feed-through body where the coupling structure includes a coupling conductor for electrically coupling the conductor of the cable to another conductor (e.g., a motor conductor, a heater conductor, etc.).

As an example, a housing (e.g., a penetrator block) may include a plurality of openings and a corresponding plurality of bores, each of the plurality of openings and bores configured for receipt of respective cable feed-through bodies. As an example, a housing may be a motor housing for an electric submersible pump (ESP), a housing for a heater, etc.

FIG. 10 shows a cut-away view of the connection unit 380. In the example of FIG. 10, cables 350-1 and 350-2 are shown as being coupled to the connection unit 380 at one end and cables 410-1 and 410-2 are shown as being coupled to the connection unit 380 at another, opposing end. At both ends of the connection unit 380, compression nuts 381-1, 381-2, 388-1 and 388-2 are disposed about an outer layer of the respective cables and fitted to a respective body portion 391 and 399 of the connection unit 380 where the two body portions 391 and 399 are joined at a joint via a coupling member 397. As shown, the two body portions 391 and 399 may be joined to form a cavity or cavities therein; noting that various bores in each of the body portions 391 and 399 may be axially aligned to form through bores in the connection unit 380 (e.g., one or more of the through bores configured for connecting respective pairs of electrical conductors).

As an example, the body portion 391 may be an uphole body portion while the body portion 399 may be a downhole body portion. As an example, the connection unit 380 may be symmetrical or otherwise configurable or agnostic to place either end of the connection 380 uphole or downhole. As an example, the connection unit 380 may be received directly by a packer (e.g., with appropriate connection fittings) or indirectly by an extension tube such as the extension tube 360, which is shown in FIG. 9 as receiving at least part of the body portion 391 of the connection unit 380.

As shown in the example of FIG. 10, each of the body portions 391 and 399 include bores with openings for receipt of cables. Each of the bores may be configured for receipt of a respective compression nut. For example, in FIG. 10, the compression nuts 381-1 and 381-2 may be torqued to apply an axial compressive force to a respective ferrule 383-1 and 385-1, for example, via an intermediate bushing with one or more seal elements 382-1 and 389-1. For example, the ferrule 383-1 may be disposed about the metal layer 358-1 of the cable 350-1, which includes the conductor 352-1, the insulator layer 354-1 and an polymeric layer 356-1 (e.g., thermoplastic such as FEP, etc.), and contact with force an inner surface of a bore of the body portion 391 of the connection unit 380, which may be a tapered bore surface 389-1 that extends to a neck through which the cable 350-1 extends axially. In such an example, the axial compressive force applied to the ferrule 383-1, due to the tapered ferrule-bore interface, may apply a radial force to the cable 350-1 to thereby form metal-to-metal-to-metal seals (e.g., metal outer layer 358-1 to metal ferrule 383-1 to metal bore surface of the body portion 391).

In the example of FIG. 10, each of the ferrules 383-1 and 385-1 includes an annular groove 384-1 and 386-1, respectively. In such an example, a passage of a sealable port 393-1 and 395-1 is disposed axially between a respective one of the annular grooves 384-1 and 386-1 and a respective one of the compression nuts 381-1 and 388-1 to allow for introduction of pressurized fluid, for example, to test the integrity of a respective one of the gland seals.

In the example of FIG. 10, the connection unit 380 includes a boot seal component 392-1 and a boot seal component 392-2, which are both disposed in an insulating block 387 that is located axially covering the joint between the two body portions 391 and 399 of the connection unit 380. Within the boot seal component 392-1, two conductive couplers 394-1 and 396-1 are seated to electrically couple the conductor 352-1 to the conductor 412-1. In the example of FIG. 10, the conductive coupler 394-1 is a female-to-female coupler while the conductive coupler 396-1 is a female-to-male coupler such as, for example, the contact pin 445 or the contact pin 585 shown in FIGS. 5, 6 and 7. In the example of FIG. 10, the boot seal component 392-1 may include sleeve portions where one latches onto the insulation layer 354-1 of the cable 350-1 and the other latches onto the insulation layer 414-1 of the cable 410-1. For example, the sleeve portions may include bumps, ribs, etc., to apply pressure to a layer of a cable (e.g., an insulator layer) to latch the cable via pressure points, for example, to assist with sealing.

As an example, the conductive couplers 394-1 and 396-1 may be made of copper and include crimpable walls. As an example, the conductive couplers 394-1 and 396-1 may be gold plated. As to the boot seal component 392-1, it may seal the conductive couplers 394-1 and 396-1 therein. The boot seal component 392-1 may be made of an elastomeric material (e.g., rubber, synthetic rubber, silicon rubber, VITON® synthetic rubber as marketed by E.I. du Pont de Nemours & Company, Wilmington, Del., KALREZ® perfluoroelastomer as marketed by E.I. du Pont de Nemours & Company, etc.) and it may be further insulated by the insulation block 387, which may be made of a plastic such as, for example, PEEK (e.g., or other poly aryl ether ketone (PAEK) type of polymer).

As mentioned, the connection unit 380 includes the two body portions 391 and 399. As an example, a cable termination seal assembly may be sealed within one of the body portions 391 or 399 where thereafter the portions 391 and 399 are brought together (e.g., with aid of the coupling member 397) and, for example, welded. As an example, the sealable ports 395-1 and 393-1 may include fluid communication passages to other gland seals within the connection unit 380. For example, pressurized fluid provided to one of the sealable ports 395-1 or 393-1 may be used to test multiple gland seals (e.g., to test three gland seals).

As an example, an assembly can include an uphole body portion and a downhole body portion, the body portions being connectable to form a cavity therein, where the uphole body portion includes an uphole bore and an uphole tapered bore surface and where the downhole body portion includes a downhole bore and a downhole tapered bore surface; an insulator block disposed within the cavity where the insulator block includes a through bore axially aligned with the uphole bore of the uphole body portion and the downhole bore of the downhole body portion; and a boot seal component disposed in the through bore of the insulator block where the boot seal component includes an uphole sleeve for latching an uphole conductor, a downhole sleeve tube for latching a downhole conductor and a coupling conductor for electrically coupling the uphole conductor and the downhole conductor. In such an example, the assembly may include the uphole conductor and the downhole conductor and a contact pin attached to one of the uphole conductor and the downhole conductor.

As an example, a uphole body portion can include a sealable test port for testing a gland seal disposed in a bore of the uphole body portion and a downhole body portion can include a sealable test port for testing a gland seal disposed in the bore of the downhole body portion.

FIG. 11 shows a perspective view and an end view of an example of an assembly 1100 that includes a penetrator block 1500 as including three cables 1440-1, 1440-2 and 1440-3 coupled thereto via coupling assemblies that include cable feed-through bodies 1460-1, 1460-2 and 1460-3. As shown, the penetrator block 1500 may be a housing, part of a housing, a motor head, for example, for a motor of an ESP, etc. The penetrator block 1500 includes opposing axial ends 1501 and 1503 (e.g., optionally with connection flanges) between which extends a bore 1505. Disposed about the bore 1505 (e.g., about 180 degrees) are three bores 1521-1, 1521-2 and 1521-3 for cables as received via their respective cable feed-through bodies 1460-1, 1460-2 and 1460-3 along with three sealable ports 1525-1, 1525-2 and 1525-3. Each of the bores 1521-1, 1521-2 and 1521-3 has a respective opening 1520-1, 1520-2 and 1520-3 disposed on a surface 1515 of a recessed region that includes recesses 1510-1, 1510-2 and 1510-3. Each of the openings 1520-1, 1520-2 and 1520-3 receives a respective bushing 1474-1, 1474-2 and 1474-3 to couple a respective cable feed-through body 1460-1, 1460-2 and 1460-3 to the penetrator block 1500.

FIG. 12 shows a cutaway view of the assembly 1100 of FIG. 11. As shown, the individual cable feed-through bodies, represented as part of a sub-assembly 1105 that includes a cable feed-through body 1460 in a perspective view, provides a male end connector 1585, for example, which may be received by a female socket assembly 1595 (e.g., for coupling to a motor winding conductor cable). In the example of FIG. 12, the sub-assembly 1105 includes the cable feed-through body 1460, which includes a sealable port 1465, an axially translateable bushing 1474 disposed thereon, a shoulder 1468, an end 1466, and a bushing 1530 mounted thereto that may be welded at the end 1466, for example, to support and secure a coupling structure 1540 that carries a coupling conductor that electrically couples to the male end connector 1585 (e.g., a contact pin).

FIG. 13 shows a perspective view of the sub-assembly 1105 along with two other cut-away views, one showing a portion of the penetrator block 1500 and another showing a portion of the sub-assembly 1105 as well as a perspective view of a contact band 1491 and a perspective view of the bushing 1530. In the example of FIG. 13, the cut-away view of the sub-assembly 1105 shows the bushing 1530 securely mounted to the end 1466 of the cable feed-through body 1460 to support the coupling structure 1540 as including a coupling conductor 1550. To more clearly illustrate the contact band 1491, the cut-away view is shown without a contact pin 1485 (see, e.g., the contact pin 1485-2 in the other cut-away view of FIG. 13) as well as, in the perspective view, the contact band 1491 by itself. As shown, a band 1493 (e.g., a securing band) may be received at an end of the coupling structure 1540, for example, to help secure the contact pin 1485 and to retain the contact band 1491 within the coupling conductor 1550. The contact band 1491 as well as various other features shown in FIGS. 11, 12 and 13 may include one or more features of corresponding components shown in, for example, FIGS. 4, 5, 6 and 7.

FIG. 14 shows a method 1400 that includes a provision block 1010 for providing a cable with a compression nut and a ferrule, a provision block 1420 for providing a housing with a cable feed-through body with a sealable port, an insertion block 1430 for inserting the cable into the cable feed-through body, a torque block 1440 for torqueing the compression nut to the cable feed-through body to apply force to the ferrule to form a seal and an introduction block 1450 for introducing a pressurized fluid via the sealable port to test the seal. In such an example, the cable feed-through body may electrically couple a conductor of the cable to another conductor.

As an example, a method may include a provision block for providing a cable with a compression nut and a ferrule, a provision block for providing a housing with a sealable port and a boot seal component, an insertion block for inserting the cable into the boot seal component, a torque block 1040 for torqueing the compression nut to the housing to apply force to the ferrule to form a seal and an introduction block 1450 for introducing a pressurized fluid via the sealable port to test the seal. In such an example, the boot seal component may electrically couple a conductor of the cable to another conductor.

CONCLUSION

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words "means for" together with an associated function.

What is claimed is:

1. An assembly comprising:

a housing that comprises an opening, a bore extending from the opening along an axis and a sealable port in fluid communication with the bore and disposed at an axial distance from the opening;

a cable feed-through body that comprises a first axial end, a second axial end, a bore extending between the axial ends, a tapered bore surface and a sealable port, the cable feed-through body being partially disposed within the bore of the housing to locate the second axial end at an axial distance from the opening of the housing that exceeds the axial distance of the sealable port of the housing to at least in part for a gland seal between the cable feed-through body and the bore of the housing, the gland seal being testable by introduction of fluid via the sealable port of the housing; and a cable, a compression nut and a ferrule wherein a portion of the cable and the ferrule are disposed in the bore of the cable feed-through body and wherein the compression nut is attached to the cable feed-through body to apply a compressive force between the ferrule and the tapered bore surface of the cable feed-through body to at least in part form a gland seal, the gland seal being testable by introduction of fluid via the sealable port of the cable feed-through body.

2. The assembly of claim 1 wherein the cable feed-through body comprises a seal element mounted thereto, the seal element disposed axially between the opening and the sealable port of the housing, and a tapered surface that forms a seal interface with a tapered surface of the bore of the housing, the seal interface disposed axially between the sealable port and the second axial end of the cable feed-through body.

3. The assembly of claim 1 further comprising a coupling structure disposed in the bore of the housing and partially in the bore of the cable feed-through body via the second axial end of the cable feed-through body.

4. The assembly of claim 3 wherein the coupling structure comprises a coupling conductor for electrically coupling a conductor of a cable disposed in the bore of the cable feed-through body to another conductor.

5. The assembly of claim 4 wherein the another conductor comprises a member selected from a group consisting of a motor conductor and a heater connector.

6. The assembly of claim 4 comprising a coupling component disposed in the bore of the cable feed-through body wherein the coupling component comprises a sleeve end for latchable receipt of a conductor of a cable and an opposing end that receives an axial length of the coupling structure for electrically coupling the conductor of the cable to the coupling conductor of the coupling structure.

7. The assembly of claim 1 wherein the ferrule comprises an annular groove.

8. The assembly of claim 1 comprising a contact pin disposed on a conductor of the cable.

9. The assembly of claim 8 further comprising a coupling structure disposed in the bore of the housing and partially in the bore of the cable feed-through body via the second axial end of the cable feed-through body wherein the coupling structure comprises a coupling conductor for electrically coupling the conductor of the cable to another conductor.

10. The assembly of claim 9 comprising the other conductor wherein the other conductor comprises a member selected from a group consisting of a motor conductor and a heater connector.

11. The assembly of claim 1 wherein the housing comprises a plurality of openings and a corresponding plurality of bores, each of the plurality of openings and bores configured for receipt of respective cable feed-through bodies.

12. The assembly of claim 1 wherein the housing comprises a motor housing for an electric submersible pump (ESP).

13. The assembly of claim 1 wherein the housing comprises a housing for a heater.

14. An assembly comprising:

a housing that comprises an opening, a bore extending from the opening along an axis and a sealable port in fluid communication with the bore and disposed at an axial distance from the opening;

a cable feed-through body that comprises a first axial end, a second axial end, a bore extending between the axial ends, a tapered bore surface and a sealable port, the cable feed-through body being partially disposed within the bore of the housing to locate the second axial end at an axial distance from the opening of the housing that exceeds the axial distance of the sealable port of the housing to at least in part for a gland seal between the cable feed-through body and the bore of the housing, the gland seal being testable by introduction of fluid via the sealable port of the housing; and a bushing that locates the coupling structure in the bore of the housing where the bushing is affixed to the cable feed-through body.

15. An assembly comprising:

an uphole body portion and a downhole body portion, the body portions being connectable to form a cavity therein, wherein the uphole body portion comprises an uphole bore and an uphole tapered bore surface and wherein the downhole body portion comprises a downhole bore and a downhole tapered bore surface;

an insulator block disposed within the cavity wherein the insulator block comprises a through bore axially aligned with the uphole bore of the uphole body portion and the downhole bore of the downhole body portion; and a boot seal component disposed in the through bore of the insulator block wherein the boot seal component comprises an uphole sleeve for latching an uphole conductor, a downhole sleeve for latching a downhole conductor and a coupling conductor for electrically coupling the uphole conductor and the downhole conductor, wherein the uphole body portion comprises a sealable test port for testing a gland seal disposed in the bore of the uphole body portion and wherein the downhole body portion comprises a sealable test port for testing a gland seal disposed in the bore of the downhole body portion.

16. The assembly of claim 15 comprising the uphole conductor and the downhole conductor and comprising a contact pin attached to one of the uphole conductor and the downhole conductor.

* * * * *